US010441844B2

(12) United States Patent
Powell

(10) Patent No.: US 10,441,844 B2
(45) Date of Patent: Oct. 15, 2019

(54) COOLING SYSTEMS AND METHODS FOR EXERCISE EQUIPMENT

(71) Applicant: ICON Health & Fitness, Inc., Logan, UT (US)

(72) Inventor: Wade A. Powell, Millville, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 158 days.

(21) Appl. No.: 15/785,302

(22) Filed: Oct. 16, 2017

(65) Prior Publication Data

US 2018/0036585 A1 Feb. 8, 2018

Related U.S. Application Data

(63) Continuation-in-part of application No. 15/639,935, filed on Jun. 30, 2017.
(Continued)

(51) Int. Cl.
*A63B 22/02* (2006.01)
*A63B 21/00* (2006.01)
(Continued)

(52) U.S. Cl.
CPC ..... *A63B 22/0257* (2013.01); *A63B 21/154* (2013.01); *A63B 22/025* (2015.10); *A63B 22/0235* (2013.01); *A63B 24/0087* (2013.01); *A63B 21/0055* (2015.10); *A63B 21/0057* (2013.01); *A63B 21/0088* (2013.01); *A63B 21/225* (2013.01); *A63B 22/0023* (2013.01); *A63B 22/0076* (2013.01); *A63B 22/02* (2013.01); *A63B 22/0605* (2013.01);
(Continued)

(58) Field of Classification Search
None
See application file for complete search history.

(56) References Cited

U.S. PATENT DOCUMENTS 232,022 A 9/1880 Gifford
284,294 A 9/1883 Graves
(Continued)

FOREIGN PATENT DOCUMENTS

TW 177052 1/1992
TW M253381 12/2004
(Continued)

OTHER PUBLICATIONS

Taiwan Office Action and Search Report issued in 106122194 dated Jan. 19, 2018 with English Translation.

*Primary Examiner* — Stephen R Crow
(74) *Attorney, Agent, or Firm* — Ray Quinney & Nebeker

(57) ABSTRACT

An exercise machine may include a deck, a motor housing incorporated into the deck, a lift motor located in the motor housing, and a cooling mechanism that cools the lift motor when the cooling mechanism is activated. An airflow pathway may be defined to direct air from the cooling mechanism to a location above the motor housing and on to a user of the exercise machine. The exercise machine may be configured such that upon beginning operation of the machine, substantially all of the airflow exhausts to the location above the motor housing. A mechanism may be provided to selectively alter a characteristic of the airflow after the exercise machine has begun operation.

19 Claims, 10 Drawing Sheets

Related U.S. Application Data

(60) Provisional application No. 62/357,815, filed on Jul. 1, 2016.

(51) Int. Cl.

| | |
|---|---|
| ***A63B 24/00*** | (2006.01) |
| *A63B 21/22* | (2006.01) |
| *A63B 21/005* | (2006.01) |
| *A63B 21/008* | (2006.01) |
| *A63B 22/00* | (2006.01) |
| *A63B 22/06* | (2006.01) |
| *A63B 71/06* | (2006.01) |

(52) U.S. Cl.

CPC ..... *A63B 22/0664* (2013.01); *A63B 2024/009* (2013.01); *A63B 2071/068* (2013.01); *A63B 2071/0638* (2013.01); *A63B 2071/0683* (2013.01); *A63B 2225/30* (2013.01); *A63B 2230/06* (2013.01)

(56) References Cited

U.S. PATENT DOCUMENTS

| | | | |
|---|---|---|---|
| 321,388 | A | 6/1885 | Ruebsam |
| 339,638 | A | 4/1886 | Goldie |
| 421,779 | A | 2/1890 | Steven |
| 447,780 | A | 3/1891 | Luge |
| 450,792 | A | 4/1891 | Dodd |
| 659,216 | A | 10/1900 | Dowling |
| 663,486 | A | 12/1900 | Boren |
| 674,391 | A | 5/1901 | Baker |
| 683,284 | A | 9/1901 | Honey |
| 766,930 | A | 8/1904 | Clemons |
| 881,521 | A | 3/1908 | Wilson |
| 897,722 | A | 9/1908 | Day |
| 931,394 | A | 8/1909 | Day |
| 937,795 | A | 10/1909 | Hackney |
| 1,016,729 | A | 2/1912 | Barrett |
| 1,020,777 | A | 3/1912 | Peterson |
| 1,064,968 | A | 6/1913 | Lauraine |
| 1,082,940 | A | 12/1913 | Flora |
| 1,211,765 | A | 1/1917 | Peter |
| 1,570,482 | A | 1/1926 | Hale |
| 1,580,530 | A | 4/1926 | Rambo |
| 1,585,748 | A | 5/1926 | Wendelken |
| 1,715,870 | A | 6/1929 | William |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,893,728 | A | 1/1933 | Bullis |
| 1,902,694 | A | 3/1933 | Edwards |
| 1,919,627 | A | 7/1933 | Fitz Gerald |
| 1,928,089 | A | 9/1933 | Blickman |
| 1,973,945 | A | 9/1934 | Chavin |
| 1,978,579 | A | 10/1934 | Hooks |
| 1,982,843 | A | 12/1934 | Traver |
| 2,067,136 | A | 1/1937 | Bridenbaugh |
| 2,117,957 | A | 5/1938 | Ritter |
| 2,165,700 | A | 7/1939 | Henry |
| 2,177,957 | A | 10/1939 | Stewart |
| 2,219,219 | A | 10/1940 | Boger |
| 2,247,946 | A | 7/1941 | Hein et al. |
| 2,255,864 | A | 9/1941 | Stephens |
| 2,315,485 | A | 4/1943 | Le Roy |
| 2,399,915 | A | 5/1946 | Drake |
| 2,440,644 | A | 4/1948 | Powell |
| 2,569,007 | A | 9/1951 | Klyce |
| 2,607,816 | A | 8/1952 | Ryder |
| 2,632,645 | A | 3/1953 | Eric |
| 2,645,539 | A | 7/1953 | Thompson |
| 2,646,282 | A | 7/1953 | Bernice |
| 2,648,540 | A | 8/1953 | William |
| 2,674,453 | A | 4/1954 | Hummert |
| 2,743,623 | A | 5/1956 | Wells |
| 2,746,822 | A | 5/1956 | Copenhaver |
| 2,842,365 | A | 7/1958 | Kelley |
| 2,855,200 | A | 10/1958 | Harry |
| 2,874,971 | A | 2/1959 | Devery |
| 2,969,060 | A | 1/1961 | Swanda |
| 2,984,594 | A | 5/1961 | Runton |
| 3,035,671 | A | 5/1962 | Sicherman |
| 3,059,312 | A | 10/1962 | Jamieson |
| 3,068,950 | A | 12/1962 | Davidson |
| 3,072,426 | A | 1/1963 | Gilbert |
| 3,112,108 | A | 11/1963 | Hanke |
| 3,127,171 | A | 3/1964 | Noland et al. |
| 3,179,071 | A | 4/1965 | Johnston |
| 3,193,287 | A | 7/1965 | Robinson |
| 3,205,888 | A | 9/1965 | Stroop |
| 3,316,898 | A | 5/1967 | Brown |
| 3,319,273 | A | 5/1967 | Lawrence |
| 3,342,485 | A | 9/1967 | Martin |
| 3,345,067 | A | 10/1967 | Smith |
| 3,358,813 | A | 12/1967 | Kohlhagen |
| 3,378,259 | A | 4/1968 | Kupchinski |
| 3,408,067 | A | 10/1968 | Armstrong |
| 3,408,069 | A | 10/1968 | Lewis |
| 3,411,497 | A | 11/1968 | Rickey et al. |
| 3,416,174 | A | 12/1968 | Novitske |
| 3,430,084 | A | 2/1969 | Hall |
| 3,430,507 | A | 3/1969 | Hurst et al. |
| 3,438,627 | A | 4/1969 | La Lanne |
| 3,444,830 | A | 5/1969 | Doetsch |
| 3,446,503 | A | 5/1969 | Lawton |
| 3,501,140 | A | 3/1970 | Eichorn |
| 3,511,500 | A | 5/1970 | Dunn |
| 3,514,110 | A | 5/1970 | Thomander |
| 3,518,985 | A | 7/1970 | Quinton |
| 3,547,435 | A | 12/1970 | Scott |
| 3,554,541 | A | 1/1971 | Spoth |
| 3,563,541 | A | 2/1971 | Sanquist |
| 3,566,861 | A | 3/1971 | Weiss |
| 3,567,219 | A | 3/1971 | Foster |
| 3,568,669 | A | 3/1971 | Stites |
| 3,572,700 | A | 3/1971 | Mastropaolo |
| 3,583,465 | A | 6/1971 | Youngs et al. |
| 3,586,322 | A | 6/1971 | Kverneland |
| 3,589,715 | A | 6/1971 | Mark |
| 3,592,466 | A | 7/1971 | Parsons |
| 3,598,404 | A | 8/1971 | Bowman |
| 3,602,502 | A | 8/1971 | Jaegar |
| 3,606,320 | A | 9/1971 | Erwin, Jr. |
| 3,608,898 | A | 9/1971 | Berlin |
| 3,614,097 | A | 10/1971 | Blickman |
| 3,628,654 | A | 12/1971 | Haracz |
| 3,628,791 | A | 12/1971 | Garcia |
| 3,634,895 | A | 1/1972 | Childers |
| 3,636,577 | A | 1/1972 | Nissen |
| 3,638,941 | A | 2/1972 | Kulkens |
| 3,640,528 | A | 2/1972 | Proctor |
| 3,641,601 | A | 2/1972 | Sieg |
| 3,642,279 | A | 2/1972 | Cutter |
| 3,643,943 | A | 2/1972 | Erwin, Jr. et al. |
| 3,650,529 | A | 3/1972 | Salm |
| 3,658,327 | A | 4/1972 | Thiede |
| 3,659,845 | A | 5/1972 | Quinton |
| 3,664,666 | A | 5/1972 | Lloyd |
| 3,686,776 | A | 8/1972 | Dahl |
| 3,689,066 | A | 9/1972 | Hagen |
| 3,703,284 | A | 11/1972 | Hesen |
| 3,708,166 | A | 1/1973 | Annas |
| 3,709,197 | A | 1/1973 | Moseley |
| 3,731,917 | A | 5/1973 | Townsend |
| 3,738,649 | A | 6/1973 | Miller |
| 3,741,538 | A | 6/1973 | Useldinger |
| 3,751,033 | A | 8/1973 | Rosenthal |
| 3,756,595 | A | 9/1973 | Hague |
| 3,767,195 | A | 10/1973 | Dimick |
| 3,788,412 | A | 1/1974 | Vincent |
| 3,792,860 | A | 2/1974 | Selnes |
| 3,809,393 | A | 5/1974 | Jones |
| 3,814,420 | A | 6/1974 | Encke |

(56) References Cited

U.S. PATENT DOCUMENTS 3,822,488 A 7/1974 Johnson
3,826,491 A 7/1974 Elder
3,848,467 A 11/1974 Flavell
3,851,874 A 12/1974 Wilkin
3,858,938 A 1/1975 Kristensson et al.
3,861,215 A 1/1975 Bradley
3,869,121 A 3/1975 Flavell
3,870,297 A 3/1975 Elder
3,874,657 A 4/1975 Niebojewski
3,880,274 A 4/1975 Bechtloff
3,883,922 A 5/1975 Fleischhauer
3,892,404 A 7/1975 Martucci
3,901,379 A 8/1975 Bruhm
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.
3,977,451 A 8/1976 Duba
3,981,500 A 9/1976 Ryan
4,012,015 A 3/1977 Nelson et al.
4,024,949 A 5/1977 Kleysteuber et al.
4,026,545 A 5/1977 Schonenberger
4,033,567 A 7/1977 Lipfert
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,072,309 A 2/1978 Wilson
4,077,626 A 3/1978 Newman
4,082,267 A 4/1978 Flavell
4,093,196 A 6/1978 Bauer
4,094,330 A 6/1978 Jong
4,111,417 A 9/1978 Gardner
4,113,071 A 9/1978 Muller et al.
4,120,294 A 10/1978 Wolfe
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.
4,208,049 A 6/1980 Wilson
4,215,516 A 8/1980 Huschle et al.
4,216,856 A 8/1980 Moring et al.
4,227,689 A 10/1980 Keiser
4,235,437 A 11/1980 Ruis et al.
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,782 A 9/1981 Fuhrhop
4,290,601 A 9/1981 Mittelstadt
4,300,761 A 11/1981 Howard
4,313,602 A 2/1982 Sullivan
4,313,603 A 2/1982 Simjian
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,342,452 A 8/1982 Summa
4,344,616 A 8/1982 Ogden
4,349,597 A 9/1982 Fine et al.
4,350,336 A 9/1982 Hanford
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,370,766 A 2/1983 Teague, Jr.
4,374,587 A 2/1983 Ogden
4,377,045 A 3/1983 Aurensan
4,383,684 A 5/1983 Schliep
4,383,714 A 5/1983 Ishida
4,397,462 A 8/1983 Wilmarth
4,406,451 A 9/1983 Gaetano
4,408,613 A 10/1983 Relyea
4,422,635 A 12/1983 Herod
4,422,636 A 12/1983 de Angeli
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,465,277 A 8/1984 Dittrich
4,476,582 A 10/1984 Strauss et al.
4,477,071 A 10/1984 Brown et al.
4,489,933 A 12/1984 Fisher
4,491,318 A 1/1985 Francke
4,494,662 A 1/1985 Clymer
4,496,147 A 1/1985 DeCloux et al.
4,499,784 A 2/1985 Shum
4,502,679 A 3/1985 De Lorenzo
4,505,474 A 3/1985 Mattox
4,505,475 A 3/1985 Olschansky et al.
4,509,510 A 4/1985 Hook
4,512,567 A 4/1985 Phillips
4,512,571 A 4/1985 Hermelin
4,522,394 A 6/1985 Broussard
4,529,194 A 7/1985 Haaheim
4,533,136 A 8/1985 Smith et al.
4,536,244 A 8/1985 Greci et al.
4,538,805 A 9/1985 Parviainen
4,542,899 A 9/1985 Hendricks
4,544,152 A 10/1985 Taitel
4,544,153 A 10/1985 Babcock
4,546,971 A 10/1985 Raasoch
4,548,405 A 10/1985 Lee
4,549,733 A 10/1985 Salyer
4,556,216 A 12/1985 Pitkanen
4,563,001 A 1/1986 Terauds
4,563,003 A 1/1986 Bugallo et al.
4,564,193 A 1/1986 Stewart
4,566,689 A 1/1986 Ogden
4,566,732 A 1/1986 Ostergaard, Sr.
4,569,518 A 2/1986 Fulks
4,571,682 A 2/1986 Silverman et al.
4,572,500 A 2/1986 Weiss
4,572,504 A 2/1986 DiBartolo
4,576,352 A 3/1986 Ogden
4,576,376 A 3/1986 Miller
4,577,860 A 3/1986 Matias et al.
4,580,983 A 4/1986 Cassini et al.
4,581,269 A 4/1986 Tilman
4,582,320 A 4/1986 Shaw
4,589,656 A 5/1986 Baldwin

(56) References Cited

U.S. PATENT DOCUMENTS 4,591,147 A 5/1986 Smith et al.
4,592,544 A 6/1986 Smith et al.
4,600,196 A 7/1986 Jones
4,601,142 A 7/1986 Frommelt
4,602,779 A 7/1986 Ogden
4,610,449 A 9/1986 Diercks, Jr.
4,614,337 A 9/1986 Schonenberger
4,616,822 A 10/1986 Trulaske
4,618,139 A 10/1986 Haaheim
4,618,140 A 10/1986 Brown
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,643,418 A 2/1987 Bart
4,645,197 A 2/1987 Mcfee
4,645,200 A 2/1987 Hix
4,645,201 A 2/1987 Evans
4,645,917 A 2/1987 Penney et al.
4,647,041 A 3/1987 Whiteley
4,650,067 A 3/1987 Brule
4,650,184 A 3/1987 Brebner
4,650,185 A 3/1987 Cartwright
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,673,177 A 6/1987 Szymski
4,674,740 A 6/1987 Iams et al.
4,674,743 A 6/1987 Hirano
4,678,185 A 7/1987 Mahnke
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,718,207 A 1/1988 Frommelt
4,720,093 A 1/1988 DelMar
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,729,558 A 3/1988 Kuo
4,729,562 A 3/1988 Pipasik
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,751,755 A 6/1988 Carey, Jr. et al.
4,756,098 A 7/1988 Boggia
4,757,987 A 7/1988 Allemand
4,759,540 A 7/1988 Yu et al.
4,771,148 A 9/1988 Bersonnet
4,772,015 A 9/1988 Carlson et al.
4,773,170 A 9/1988 Moore et al.
4,776,582 A 10/1988 Ramhorst
4,779,884 A 10/1988 Minati
4,786,049 A 11/1988 Lautenschlager
4,786,050 A 11/1988 Geschwender
4,790,528 A 12/1988 Nakao et al.
4,792,134 A 12/1988 Chen
4,797,968 A 1/1989 Wenzlick
4,798,760 A 1/1989 Diaz-Kotti
4,799,475 A 1/1989 Iams et al.
4,799,671 A 1/1989 Hoggan et al.
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,832,332 A 5/1989 Dumbser
4,836,530 A 6/1989 Stanley, Jr.
4,838,543 A 6/1989 Armstrong et al.
4,838,544 A 6/1989 Sasakawa et al.
4,842,266 A 6/1989 Sweeney, Sr.
4,842,274 A 6/1989 Oosthuizen
4,844,449 A 7/1989 Truslaske
4,844,450 A 7/1989 Rodgers, Jr.
4,848,737 A 7/1989 Ehrenfield
4,850,585 A 7/1989 Dalebout
4,861,023 A 8/1989 Wedman
4,861,025 A 8/1989 Rockwell
4,863,161 A 9/1989 Telle
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,883,272 A 11/1989 Lay
4,886,266 A 12/1989 Trulaske
4,891,764 A 1/1990 McIntosh
4,894,933 A 1/1990 Tonkel et al.
4,898,379 A 2/1990 Shiba
4,898,381 A 2/1990 Gordon
4,900,012 A 2/1990 Fu
4,900,017 A 2/1990 Bold, Jr.
4,900,018 A 2/1990 Ish, III
4,902,006 A 2/1990 Stallings, Jr.
4,904,829 A 2/1990 Berthaud et al.
4,905,330 A 3/1990 Jacobs
4,907,795 A 3/1990 Shaw et al.

(56) References Cited

U.S. PATENT DOCUMENTS 4,907,797 A 3/1990 Gezari et al.
4,907,798 A 3/1990 Burchatz
4,909,504 A 3/1990 Yang
4,911,438 A 3/1990 Van Straaten
4,913,396 A 4/1990 Dalebout et al.
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim
4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,934,690 A 6/1990 Bull
4,934,692 A 6/1990 Owens
4,938,473 A 7/1990 Clayton
4,940,233 A 7/1990 Bull
4,941,652 A 7/1990 Nagano et al.
4,941,673 A 7/1990 Bennett
4,948,121 A 8/1990 Haaheim et al.
4,949,954 A 8/1990 Hix
4,949,958 A 8/1990 Richey
4,949,959 A 8/1990 Stevens
4,952,265 A 8/1990 Yamanaka et al.
4,953,415 A 9/1990 Oy
4,953,858 A 9/1990 Zelli
4,955,466 A 9/1990 Almes et al.
4,958,832 A 9/1990 Kim
4,960,276 A 10/1990 Feuer et al.
4,964,632 A 10/1990 Rockwell
4,968,028 A 11/1990 Wehrell
4,971,316 A 11/1990 Dalebout et al.
4,974,831 A 12/1990 Dunham
4,974,832 A 12/1990 Dalebout
4,976,424 A 12/1990 Sargeant et al.
4,976,428 A 12/1990 Ghazi
4,976,435 A 12/1990 Shatford
4,984,810 A 1/1991 Stearns et al.
4,986,261 A 1/1991 Iams et al.
4,989,860 A 2/1991 Iams et al.
4,998,725 A 3/1991 Watterson et al.
5,000,440 A 3/1991 Lynch
5,000,442 A 3/1991 Dalebout et al.
5,001,632 A 3/1991 Hall-Tipping
5,002,271 A 3/1991 Gonzales
5,004,224 A 4/1991 Wang
5,007,630 A 4/1991 Real et al.
5,007,631 A 4/1991 Wang
5,013,031 A 5/1991 Bull
5,016,870 A 5/1991 Bulloch et al.
5,020,793 A 6/1991 Loane
5,024,441 A 6/1991 Rousseau
5,026,049 A 6/1991 Goodman
5,027,303 A 6/1991 Witte
5,029,801 A 7/1991 Dalebout et al.
5,031,455 A 7/1991 Cline
5,031,901 A 7/1991 Saarinen
5,034,576 A 7/1991 Dalebout et al.
RE33,662 E 8/1991 Blair et al.
5,037,084 A 8/1991 Flor
5,037,089 A 8/1991 Spagnuolo
5,039,089 A 8/1991 Lapcevic
5,039,091 A 8/1991 Johnson
5,042,799 A 8/1991 Stanley
5,046,382 A 9/1991 Steinberg
5,046,722 A 9/1991 Antoon
5,048,823 A 9/1991 Bean
5,051,638 A 9/1991 Pyles
5,054,770 A 10/1991 Bull
5,058,881 A 10/1991 Measom
5,058,882 A 10/1991 Dalebout et al.
5,058,888 A 10/1991 Walker et al.
5,062,626 A 11/1991 Dalebout et al.
5,062,629 A 11/1991 Vaughan
5,062,632 A 11/1991 Dalebout et al.
5,066,000 A 11/1991 Dolan
5,067,710 A 11/1991 Watterson et al.
5,071,115 A 12/1991 Welch
5,072,928 A 12/1991 Stearns et al.
5,072,929 A 12/1991 Peterson et al.
5,074,550 A 12/1991 Sloan
5,077,916 A 1/1992 Beneteau
5,080,353 A 1/1992 Tench
5,081,991 A 1/1992 Chance
5,085,426 A 2/1992 Wanzer et al.
5,085,427 A 2/1992 Finn
5,087,047 A 2/1992 McConnell
5,088,729 A 2/1992 Dalebout
5,094,249 A 3/1992 Marras et al.
5,094,447 A 3/1992 Wang
5,096,225 A 3/1992 Osawa
5,102,122 A 4/1992 Piane, Jr.
5,102,380 A 4/1992 Jacobson et al.
5,104,119 A 4/1992 Lynch
5,104,120 A 4/1992 Watterson et al.
5,108,093 A 4/1992 Watterson
5,109,778 A 5/1992 Berkowitz et al.
5,110,117 A 5/1992 Fisher et al.
5,112,045 A 5/1992 Mason et al.
5,114,388 A 5/1992 Trulaske
5,114,391 A 5/1992 Pitzen et al.
5,123,629 A 6/1992 Takeuchi
5,123,885 A 6/1992 Shields
5,123,886 A 6/1992 Cook
5,129,872 A 7/1992 Dalton et al.
5,131,895 A 7/1992 Rogers, Jr.
5,135,458 A 8/1992 Huang
5,137,501 A 8/1992 Mertesdorf
5,138,730 A 8/1992 Masuda
5,141,480 A 8/1992 Lennox et al.
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,158,520 A 10/1992 Lemke et al.
5,162,029 A 11/1992 Gerard
5,163,885 A 11/1992 Wanzer et al.
5,167,159 A 12/1992 Lucking
5,167,597 A 12/1992 David
5,171,196 A 12/1992 Lynch
5,178,593 A 1/1993 Roberts
5,178,599 A 1/1993 Scott
5,181,894 A 1/1993 Shieng
5,184,295 A 2/1993 Mann
5,184,988 A 2/1993 Dunham
5,186,697 A 2/1993 Rennex
5,192,255 A 3/1993 Dalebout et al.
5,192,257 A 3/1993 Panasewicz
5,192,258 A 3/1993 Keller
5,195,781 A 3/1993 Osawa
5,195,935 A 3/1993 Fencel
5,195,937 A 3/1993 Engel et al.
5,199,931 A 4/1993 Easley et al.
5,201,694 A 4/1993 Zappel
5,203,229 A 4/1993 Chen
5,203,800 A 4/1993 Meredith
5,203,826 A 4/1993 Dalebout
5,205,798 A 4/1993 Lekhtman
5,205,800 A 4/1993 Grant
5,207,489 A 5/1993 Miller
5,207,622 A 5/1993 Wilkinson et al.
5,207,625 A 5/1993 White
5,207,628 A 5/1993 Graham
5,211,617 A 5/1993 Millen

(56) References Cited

U.S. PATENT DOCUMENTS 5,215,510 A 6/1993 Baran
5,217,422 A 6/1993 Domzalski
5,226,866 A 7/1993 Engel et al.
5,232,422 A 8/1993 Bishop, Jr.
5,234,392 A 8/1993 Clark
5,240,417 A 8/1993 Smithson et al.
5,242,339 A 9/1993 Thornton
5,242,340 A 9/1993 Jerome
5,242,343 A 9/1993 Miller
5,242,347 A 9/1993 Keeton
5,247,853 A 9/1993 Dalebout
5,250,012 A 10/1993 Whitcomb, Jr.
5,250,013 A 10/1993 Brangi
5,254,067 A 10/1993 Habing et al.
5,256,117 A 10/1993 Potts et al.
5,256,118 A 10/1993 Chen
5,256,126 A 10/1993 Grotstein
5,257,701 A 11/1993 Edelson
5,257,964 A 11/1993 Petters
5,261,864 A 11/1993 Fitzpatrick
5,269,736 A 12/1993 Roberts
5,271,416 A 12/1993 Lepley
5,273,285 A 12/1993 Long
5,277,678 A 1/1994 Friedebach et al.
5,279,528 A 1/1994 Dalebout et al.
5,279,529 A 1/1994 Eschenbach
5,279,531 A 1/1994 Jen Huey
5,282,776 A 2/1994 Dalebout
5,284,461 A 2/1994 Wilkinson et al.
5,290,205 A 3/1994 Densmore et al.
5,290,211 A 3/1994 Stearns
5,292,293 A 3/1994 Schumacher
5,295,928 A 3/1994 Rennex
5,295,935 A 3/1994 Wang
5,299,992 A 4/1994 Wilkinson
5,299,993 A 4/1994 Habing
5,302,162 A 4/1994 Pasero
5,306,221 A 4/1994 Itaru
5,308,075 A 5/1994 Theriault
5,308,304 A 5/1994 Habing
5,310,392 A 5/1994 Lo
5,313,852 A 5/1994 Arena
5,314,390 A 5/1994 Westing et al.
5,314,391 A 5/1994 Potash et al.
5,314,392 A 5/1994 Hawkins et al.
5,314,394 A 5/1994 Ronan
5,318,487 A 6/1994 Golen et al.
5,320,343 A 6/1994 McKinney
5,320,588 A 6/1994 Wanzer et al.
5,320,591 A 6/1994 Harmon et al.
5,324,242 A 6/1994 Lo
5,328,420 A 7/1994 Allen
5,328,422 A 7/1994 Nichols
5,328,429 A 7/1994 Potash et al.
5,330,401 A 7/1994 Walstead
5,330,402 A 7/1994 Johnson
5,334,120 A 8/1994 Rasmussen
5,336,144 A 8/1994 Rodden
5,336,145 A 8/1994 Keiser
5,336,146 A 8/1994 Piaget et al.
5,342,264 A 8/1994 Gordon
5,342,271 A 8/1994 Long
RE34,728 E 9/1994 Hall-Tipping
5,344,372 A 9/1994 Hung
5,348,524 A 9/1994 Grant
5,350,344 A 9/1994 Kissel
5,352,166 A 10/1994 Chang
5,352,167 A 10/1994 Ulicny
5,352,169 A 10/1994 Eschenbach
5,353,452 A 10/1994 Rulis
5,354,248 A 10/1994 Rawls et al.
5,354,251 A 10/1994 Sleamaker
5,356,356 A 10/1994 Hildebrandt et al.
5,358,461 A 10/1994 Bailey, Jr.
5,359,986 A 11/1994 Magrath, III et al.
5,362,069 A 11/1994 Hall-Tipping
5,362,295 A 11/1994 Nurge
5,364,327 A 11/1994 Graham
5,368,532 A 11/1994 Farnet
5,372,556 A 12/1994 Ropp
5,372,559 A 12/1994 Dalebout et al.
5,372,560 A 12/1994 Chang
5,372,564 A 12/1994 Spirito
5,374,227 A 12/1994 Webb
5,378,212 A 1/1995 Pin-Kuo
5,380,258 A 1/1995 Hawley, Jr.
5,382,207 A 1/1995 Skowronski et al.
5,382,208 A 1/1995 Hu
5,382,209 A 1/1995 Pasier
5,383,827 A 1/1995 Stern
5,383,828 A 1/1995 Sands et al.
5,385,346 A 1/1995 Carroll et al.
5,385,519 A 1/1995 Hsu
5,387,169 A 2/1995 Wang
5,387,170 A 2/1995 Rawls et al.
5,387,171 A 2/1995 Casey et al.
5,394,922 A 3/1995 Colson et al.
5,396,876 A 3/1995 Liscio et al.
5,398,948 A 3/1995 Mathis
5,401,226 A 3/1995 Stearns
5,403,251 A 4/1995 Belsito et al.
5,403,252 A 4/1995 Leon et al.
5,403,253 A 4/1995 Gaylord
5,403,254 A 4/1995 Lundin et al.
5,403,255 A 4/1995 Johnston
5,406,661 A 4/1995 Pekar
5,407,403 A 4/1995 Coleman
5,407,408 A 4/1995 Wilkinson
5,409,435 A 4/1995 Daniels
RE34,959 E 5/1995 Potts
5,410,971 A 5/1995 Golden et al.
5,417,643 A 5/1995 Taylor
5,419,570 A 5/1995 Bollotte
5,419,571 A 5/1995 Vaughan
5,419,751 A 5/1995 Byrd et al.
5,423,729 A 6/1995 Eschenbach
5,423,730 A 6/1995 Hirsch
5,429,563 A 7/1995 Engel et al.
5,429,569 A 7/1995 Gunnari
5,431,612 A 7/1995 Holden
5,433,679 A 7/1995 Szymczak et al.
5,435,315 A 7/1995 McPhee et al.
5,435,798 A 7/1995 Habing et al.
5,441,467 A 8/1995 Stevens
5,441,468 A 8/1995 Deckers et al.
5,449,334 A 9/1995 Kingsbury
5,454,772 A 10/1995 Rodden
5,454,773 A 10/1995 Blanchard et al.
5,456,648 A 10/1995 Edinburg
5,460,586 A 10/1995 Wilkinson
5,462,503 A 10/1995 Benjamin et al.
5,462,504 A 10/1995 Trulaske et al.
5,466,200 A 11/1995 Ulrich et al.
5,466,203 A 11/1995 Chen
5,470,298 A 11/1995 Curtis
5,471,405 A 11/1995 Marsh
5,474,087 A 12/1995 Nashner
5,474,510 A 12/1995 Chen
5,476,430 A 12/1995 Lee et al.
5,484,358 A 1/1996 Wang et al.
5,484,362 A 1/1996 Skowronski et al.
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,520 A 2/1996 Brown
5,496,235 A 3/1996 Stevens
5,496,236 A 3/1996 Buonauito
5,496,238 A 3/1996 Taylor
5,496,239 A 3/1996 Kallman
5,499,956 A 3/1996 Habing et al.
5,505,011 A 4/1996 Bleimhofer
5,507,271 A 4/1996 Actor

(56) References Cited

U.S. PATENT DOCUMENTS 5,509,870 A 4/1996 Lloyd
5,512,025 A 4/1996 Dalebout et al.
5,512,029 A 4/1996 Barnard
5,514,053 A 5/1996 Hawkins et al.
5,518,471 A 5/1996 Hettinger et al.
5,518,473 A 5/1996 Miller
5,520,599 A 5/1996 Chen
5,522,783 A 6/1996 Gordon
5,527,245 A 6/1996 Dalebout et al.
5,529,554 A 6/1996 Eschenbach
5,531,658 A 7/1996 Liao
5,533,899 A 7/1996 Young
5,533,948 A 7/1996 Wilkinson
5,533,951 A 7/1996 Chang
5,538,489 A 7/1996 Magid
5,542,892 A 8/1996 Buhler et al.
5,545,112 A 8/1996 Hoffman
5,549,052 A 8/1996 Hoffman
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,556,362 A 9/1996 Whipps
5,562,572 A 10/1996 Carmein
5,562,574 A 10/1996 Miller
5,563,487 A 10/1996 Davis
5,568,993 A 10/1996 Potzick
5,569,128 A 10/1996 Dalebout
5,569,138 A 10/1996 Wang et al.
5,573,485 A 11/1996 Geschwender
5,575,740 A 11/1996 Piaget
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,585,561 A 12/1996 Bahl et al.
5,586,736 A 12/1996 Mollet
5,588,938 A 12/1996 Schneider et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,599,261 A 2/1997 Easley et al.
5,600,310 A 2/1997 Whipple, III et al.
5,603,675 A 2/1997 Wu
5,603,678 A 2/1997 Wilson
5,607,375 A 3/1997 Dalebout
5,613,216 A 3/1997 Galler
5,613,856 A 3/1997 Hoover
5,616,103 A 4/1997 Lee
5,622,527 A 4/1997 Watterson et al.
5,625,577 A 4/1997 Kunii et al.
5,626,539 A 5/1997 Piaget
5,630,566 A 5/1997 Case
5,632,209 A 5/1997 Sakakibara
5,634,870 A 6/1997 Wilkinson
5,643,142 A 7/1997 Salerno et al.
5,643,144 A 7/1997 Trulaske
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,914 A 7/1997 Horowitz
5,649,882 A 7/1997 Parikh et al.
5,650,709 A 7/1997 Rotunda et al.
5,653,662 A 8/1997 Rodgers, Jr.
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Hsieh
5,665,033 A 9/1997 Palmer
5,667,459 A 9/1997 Su
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,624 A 10/1997 Watterson et al.
5,679,047 A 10/1997 Engel
5,679,101 A 10/1997 Magid
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,695,436 A 12/1997 Huang
5,702,325 A 12/1997 Watterson et al.
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,711,745 A 1/1998 Yang
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,722,917 A 3/1998 Olschansky et al.
5,722,920 A 3/1998 Bauer
5,722,922 A 3/1998 Watterson et al.
5,725,459 A 3/1998 Rexach
5,730,236 A 3/1998 Miller et al.
5,733,228 A 3/1998 Stevens
5,733,229 A 3/1998 Dalebout et al.
5,735,586 A 4/1998 Cheng
5,735,773 A 4/1998 Vittone
5,735,776 A 4/1998 Swezey
5,738,612 A 4/1998 Tsuda
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,749,372 A 5/1998 Allen
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,755,642 A 5/1998 Miller
5,755,645 A 5/1998 Miller et al.
5,755,651 A 5/1998 Homyonfer
5,759,136 A 6/1998 Chen
5,760,353 A 6/1998 Rapp
5,761,831 A 6/1998 Cho
5,762,587 A 6/1998 Dalebout et al.
5,762,588 A 6/1998 Chen
5,769,759 A 6/1998 Alter
5,771,152 A 6/1998 Crompton et al.
5,772,522 A 6/1998 Nesbit
5,772,558 A 6/1998 Rodgers, Jr.
5,772,560 A 6/1998 Watterson et al.
5,776,582 A 7/1998 Needham
5,779,599 A 7/1998 Chen
5,779,607 A 7/1998 Harris

(56) References Cited

U.S. PATENT DOCUMENTS 5,782,639 A 7/1998 Beal
5,782,723 A 7/1998 Kuo
5,785,630 A 7/1998 Bobick et al.
5,788,609 A 8/1998 Miller
5,788,610 A 8/1998 Eschenbach
5,788,611 A 8/1998 Kuo
5,792,027 A 8/1998 Gvoich
5,792,031 A 8/1998 Alton
5,795,270 A 8/1998 Woods et al.
5,797,578 A 8/1998 Graffeo
5,803,874 A 9/1998 Wilkinson
5,803,877 A 9/1998 Franey
5,803,882 A 9/1998 Habing et al.
5,807,210 A 9/1998 Devlin
5,810,696 A 9/1998 Webb
5,810,697 A 9/1998 Joiner
5,810,698 A 9/1998 Hullett et al.
5,813,142 A 9/1998 Demon
5,813,947 A 9/1998 Densmore
5,813,953 A 9/1998 Whipple
5,816,981 A 10/1998 Hung
5,820,478 A 10/1998 Wood et al.
5,823,618 A 10/1998 Fox et al.
5,827,155 A 10/1998 Jensen et al.
5,827,158 A 10/1998 Drecksel
5,830,107 A 11/1998 Brigliadoro
5,830,113 A 11/1998 Coody et al.
5,830,114 A 11/1998 Halfen et al.
5,833,577 A 11/1998 Hurt
5,833,583 A 11/1998 Chuang
5,833,584 A 11/1998 Piaget et al.
5,833,587 A 11/1998 Strong et al.
5,836,770 A 11/1998 Powers
5,839,990 A 11/1998 Virkkala
5,839,993 A 11/1998 Fox
5,842,961 A 12/1998 Davis
5,846,166 A 12/1998 Kuo
5,848,954 A 12/1998 Stearns et al.
5,852,264 A 12/1998 Muller
5,855,537 A 1/1999 Coody et al.
5,855,538 A 1/1999 Argabright
5,857,939 A 1/1999 Kaufman
5,857,940 A 1/1999 Husted
5,857,941 A 1/1999 Maresh
5,857,943 A 1/1999 Murray
5,860,893 A 1/1999 Watterson et al.
5,860,894 A 1/1999 Dalebout et al.
5,860,899 A 1/1999 Rassman
5,865,710 A 2/1999 Wilson-Hyde
5,868,108 A 2/1999 Schmitz et al.
5,868,648 A 2/1999 Coody et al.
5,871,421 A 2/1999 Trulaske et al.
5,876,095 A 3/1999 Johnston
5,879,271 A 3/1999 Stearns et al.
5,879,273 A 3/1999 Wei
5,879,276 A 3/1999 Miller
5,882,281 A 3/1999 Stearns et al.
5,885,197 A 3/1999 Barton
5,888,172 A 3/1999 Andrus et al.
5,890,562 A 4/1999 Bartels et al.
5,890,995 A 4/1999 Bobick et al.
5,891,001 A 4/1999 Carnes et al.
5,891,003 A 4/1999 Deac et al.
5,895,339 A 4/1999 Maresh
5,895,340 A 4/1999 Keller
5,897,457 A 4/1999 Mackovjak
5,897,459 A 4/1999 Habing et al.
5,897,460 A 4/1999 McBride et al.
5,897,461 A 4/1999 Socwell
5,899,833 A 5/1999 Ryan et al.
5,899,834 A 5/1999 Dalebout et al.
5,902,214 A 5/1999 Makikawa et al.
5,904,398 A 5/1999 Farricielli
5,904,636 A 5/1999 Chen
5,906,269 A 5/1999 Zabron et al.
5,906,564 A 5/1999 Jacobsen
5,910,070 A 6/1999 Henry et al.
5,910,072 A 6/1999 Rawls et al.
5,911,132 A 6/1999 Sloane
5,913,751 A 6/1999 Eschenbach
5,916,064 A 6/1999 Eschenbach
5,916,069 A 6/1999 Wang
5,917,692 A 6/1999 Schmitz et al.
5,919,118 A 7/1999 Stearns
5,921,892 A 7/1999 Easton
5,921,896 A 7/1999 Boland
5,925,001 A 7/1999 Hoyt et al.
5,938,551 A 8/1999 Warner
5,938,565 A 8/1999 Bernacki
5,938,570 A 8/1999 Maresh
5,938,571 A 8/1999 Stevens
5,938,575 A 8/1999 Stearns
5,940,502 A 8/1999 Hirai et al.
5,940,911 A 8/1999 Wang
5,941,807 A 8/1999 Cassidy
5,943,794 A 8/1999 Gelsomini
5,944,641 A 8/1999 Habing
5,947,869 A 9/1999 Shea
5,947,872 A 9/1999 Ryan et al.
5,951,444 A 9/1999 Webber
5,951,447 A 9/1999 Butler
5,951,449 A 9/1999 Oppriecht
5,957,814 A 9/1999 Eschenbach
5,961,423 A 10/1999 Sellers
5,961,430 A 10/1999 Zuckerman et al.
5,967,944 A 10/1999 Vittone et al.
5,967,954 A 10/1999 Habing
5,967,955 A 10/1999 Westfall et al.
5,971,902 A 10/1999 Robertson et al.
5,976,039 A 11/1999 Epel et al.
5,976,061 A 11/1999 Moon et al.
5,980,430 A 11/1999 Wang
5,980,432 A 11/1999 Ahman
5,984,798 A 11/1999 Gilmour
5,984,839 A 11/1999 Corkum
5,989,161 A 11/1999 Wang et al.
5,989,163 A 11/1999 Rodgers, Jr.
5,989,168 A 11/1999 See
5,991,143 A 11/1999 Wright et al.
5,993,358 A 11/1999 Gureghian et al.
5,993,359 A 11/1999 Eschenbach
5,993,362 A 11/1999 Ghobadi
5,997,447 A 12/1999 Giannelli et al.
5,997,450 A 12/1999 Wilkinson
6,003,481 A 12/1999 Pischinger et al.
6,004,244 A 12/1999 Simonson
6,006,379 A 12/1999 Hensley
6,010,432 A 1/2000 Vawter
6,012,591 A 1/2000 Brandenberg
6,012,772 A 1/2000 Conde et al.
6,013,011 A 1/2000 Moore et al.
6,015,367 A 1/2000 Scaramucci
6,015,368 A 1/2000 Clem
6,027,429 A 2/2000 Daniels
6,027,430 A 2/2000 Stearns et al.
6,027,432 A 2/2000 Cheng
6,030,320 A 2/2000 Stearns
6,030,321 A 2/2000 Fuentes
6,030,323 A 2/2000 Fontenot
6,033,344 A 3/2000 Trulaske et al.
6,033,347 A 3/2000 Dalebout et al.
6,033,350 A 3/2000 Krull
6,036,622 A 3/2000 Gordon
6,042,512 A 3/2000 Eschenbach
6,042,514 A 3/2000 Abelbeck
6,042,515 A 3/2000 Wang
6,042,516 A 3/2000 Norton
6,042,518 A 3/2000 Hildebrandt et al.
6,042,523 A 3/2000 Graham
6,045,487 A 4/2000 Miller
6,045,488 A 4/2000 Eschenbach
6,045,490 A 4/2000 Shafer
6,045,491 A 4/2000 McNergney et al.
6,050,920 A 4/2000 Ehrenfried

(56) References Cited

U.S. PATENT DOCUMENTS

| | | | |
|---|---|---|---|
| 6,050,921 | A | 4/2000 | Wang |
| 6,050,922 | A | 4/2000 | Wang |
| 6,050,923 | A | 4/2000 | Yu |
| 6,053,844 | A | 4/2000 | Clem |
| 6,053,847 | A | 4/2000 | Stearns et al. |
| 6,053,848 | A | 4/2000 | Eschenbach |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,063,009 | A | 5/2000 | Stearns |
| 6,066,075 | A | 5/2000 | Poulton |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,080,091 | A | 6/2000 | Habing et al. |
| 6,086,520 | A | 7/2000 | Rodriquez |
| 6,090,014 | A | 7/2000 | Eschenbach |
| 6,090,016 | A | 7/2000 | Kuo |
| 6,095,951 | A | 8/2000 | Skowronski et al. |
| 6,099,439 | A | 8/2000 | Ryan et al. |
| 6,102,412 | A | 8/2000 | Staffaroni |
| 6,102,832 | A | 8/2000 | Tani |
| 6,110,076 | A | 8/2000 | Hurt |
| 6,110,077 | A | 8/2000 | Yu |
| 6,113,188 | A | 9/2000 | Stewart et al. |
| 6,113,522 | A | 9/2000 | Montgomery |
| 6,117,049 | A | 9/2000 | Lowe |
| 6,120,421 | A | 9/2000 | Kuo |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,129,962 | A | 10/2000 | Quigley et al. |
| 6,132,340 | A | 10/2000 | Wang |
| 6,135,924 | A | 10/2000 | Gibbs et al. |
| 6,135,925 | A | 10/2000 | Liu |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,149,551 | A | 11/2000 | Pyles et al. |
| 6,149,552 | A | 11/2000 | Chen |
| 6,152,856 | A | 11/2000 | Studor et al. |
| 6,152,859 | A | 11/2000 | Stearns |
| 6,162,183 | A | 12/2000 | Hoover |
| 6,163,451 | A | 12/2000 | Chiu |
| 6,165,107 | A | 12/2000 | Birrell |
| 6,168,551 | B1 | 1/2001 | Mcguinness |
| 6,171,216 | B1 | 1/2001 | Wang |
| 6,174,267 | B1 | 1/2001 | Dalebout |
| 6,174,268 | B1 | 1/2001 | Novak |
| 6,176,814 | B1 | 1/2001 | Ryan et al. |
| 6,179,753 | B1 | 1/2001 | Barker et al. |
| 6,181,647 | B1 | 1/2001 | Tipton |
| 6,183,397 | B1 | 2/2001 | Stearns et al. |
| 6,186,290 | B1 | 2/2001 | Carlson |
| 6,186,460 | B1 | 2/2001 | Lin |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,635 | B1 | 2/2001 | Webber et al. |
| 6,203,474 | B1 | 3/2001 | Jones |
| 6,206,795 | B1 | 3/2001 | Ou |
| 6,210,305 | B1 | 4/2001 | Eschenbach |
| 6,213,919 | B1 | 4/2001 | Wang |
| 6,215,870 | B1 | 4/2001 | Hirai et al. |
| 6,217,487 | B1 | 4/2001 | Reinert |
| 6,220,990 | B1 | 4/2001 | Crivello |
| 6,220,995 | B1 | 4/2001 | Chen |
| 6,224,516 | B1 | 5/2001 | Disch |
| 6,224,519 | B1 | 5/2001 | Doolittle |
| 6,230,047 | B1 | 5/2001 | McHugh |
| 6,230,460 | B1 | 5/2001 | Huyett |
| 6,231,482 | B1 | 5/2001 | Thompson |
| 6,231,946 | B1 | 5/2001 | Brown, Jr. et al. |
| 6,234,935 | B1 | 5/2001 | Chu |
| 6,234,936 | B1 | 5/2001 | Wang |
| 6,237,583 | B1 | 5/2001 | Ripley et al. |
| 6,238,323 | B1 | 5/2001 | Simonson |
| 6,241,638 | B1 | 6/2001 | Hurt |
| 6,244,988 | B1 | 6/2001 | Delman |
| 6,244,992 | B1 | 6/2001 | James |
| 6,245,001 | B1 | 6/2001 | Siaperas |
| 6,251,047 | B1 | 6/2001 | Stearns et al. |
| 6,251,048 | B1 | 6/2001 | Kaufman |
| 6,254,514 | B1 | 7/2001 | Maresh et al. |
| 6,254,515 | B1 | 7/2001 | Carman et al. |
| 6,261,209 | B1 | 7/2001 | Coody |
| 6,264,586 | B1 | 7/2001 | Webber |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,896 | B1 | 9/2001 | Grunfeld |
| 6,287,240 | B1 | 9/2001 | Trabbic |
| 6,293,375 | B1 | 9/2001 | Chen |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,312,363 | B1 | 11/2001 | Watterson et al. |
| 6,314,667 | B1 | 11/2001 | Rife et al. |
| 6,315,486 | B1 | 11/2001 | Lunz |
| 6,322,059 | B1 | 11/2001 | Kelm et al. |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,344,986 | B1 | 2/2002 | Jain et al. |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,357,077 | B1 | 3/2002 | Jones, Jr. et al. |
| 6,361,476 | B1 | 3/2002 | Eschenbach |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,390,953 | B1 | 5/2002 | Maresh |
| 6,390,955 | B1 | 5/2002 | Wang |

(56) References Cited

U.S. PATENT DOCUMENTS

| | | | |
|---|---|---|---|
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,666 | B2 | 6/2002 | Krull |
| 6,409,632 | B1 | 6/2002 | Eschenbach |
| 6,409,633 | B1 | 6/2002 | Abelbeck |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,419,611 | B1 | 7/2002 | Levine et al. |
| 6,422,976 | B1 | 7/2002 | Eschenbach |
| 6,422,977 | B1 | 7/2002 | Eschenbach |
| 6,422,983 | B1 | 7/2002 | Weck |
| 6,428,449 | B1 | 8/2002 | Apseloff |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,447,424 | B1 | 9/2002 | Ashby et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,461,275 | B1 | 10/2002 | Wang et al. |
| 6,461,279 | B1 | 10/2002 | Kuo |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,475,121 | B2 | 11/2002 | Wang |
| 6,478,721 | B1 | 11/2002 | Hunter |
| 6,482,128 | B1 | 11/2002 | Michalow |
| 6,482,130 | B1 | 11/2002 | Pasero et al. |
| 6,482,132 | B2 | 11/2002 | Eschenbach |
| 6,485,397 | B1 | 11/2002 | Manderbacka |
| 6,488,020 | B1 | 12/2002 | Rosas-Magallan |
| 6,491,610 | B1 | 12/2002 | Henn |
| 6,494,814 | B1 | 12/2002 | Wang |
| 6,494,817 | B2 | 12/2002 | Lake |
| 6,500,097 | B1 | 12/2002 | Hall |
| 6,503,173 | B2 | 1/2003 | Clem |
| 6,505,503 | B1 | 1/2003 | Teresi et al. |
| 6,514,180 | B1 | 2/2003 | Rawls |
| 6,520,891 | B1 | 2/2003 | Stephens, Jr. |
| 6,527,674 | B1 | 3/2003 | Clem |
| 6,527,678 | B1 | 3/2003 | Wang |
| 6,527,685 | B2 | 3/2003 | Endelman et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,539,931 | B2 | 4/2003 | Trajkovic et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |
| 6,551,218 | B2 | 4/2003 | Goh |
| 6,551,223 | B2 | 4/2003 | Cheng |
| 6,554,749 | B2 | 4/2003 | Iund et al. |
| 6,558,301 | B1 | 5/2003 | Jackson |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,579,210 | B1 | 6/2003 | Stearns et al. |
| 6,582,342 | B2 | 6/2003 | Kaufman |
| 6,582,344 | B2 | 6/2003 | Tang |
| 6,585,624 | B1 | 7/2003 | Chen |
| 6,585,626 | B2 | 7/2003 | McBride |
| 6,589,138 | B2 | 7/2003 | Dyer et al. |
| 6,592,502 | B1 | 7/2003 | Phillips |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,604,008 | B2 | 8/2003 | Chudley et al. |
| 6,605,020 | B1 | 8/2003 | Huang |
| 6,609,478 | B2 | 8/2003 | Del Valle |
| 6,610,063 | B2 | 8/2003 | Kumar et al. |
| 6,612,969 | B2 | 9/2003 | Eschenbach |
| 6,612,971 | B1 | 9/2003 | Morris |
| 6,619,681 | B2 | 9/2003 | Gutierrez |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,909 | B1 | 10/2003 | Stearns et al. |
| 6,629,910 | B1 | 10/2003 | Krull |
| 6,632,161 | B1 | 10/2003 | Nir |
| 6,634,996 | B2 | 10/2003 | Jacobsen |
| 6,637,811 | B2 | 10/2003 | Zheng |
| 6,637,818 | B2 | 10/2003 | Williams |
| 6,645,125 | B1 | 11/2003 | Stearns et al. |
| 6,645,126 | B1 | 11/2003 | Martin et al. |
| 6,645,130 | B2 | 11/2003 | Webber |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,424 | B2 | 11/2003 | Dalebout |
| 6,652,425 | B1 | 11/2003 | Martin et al. |
| 6,652,429 | B2 | 11/2003 | Bushnell |
| 6,660,949 | B2 | 12/2003 | Kamino et al. |
| 6,661,136 | B1 | 12/2003 | Lee |
| 6,663,127 | B2 | 12/2003 | Miller |
| 6,663,498 | B2 | 12/2003 | Stipan |
| 6,663,500 | B2 | 12/2003 | Huang |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,572 | B2 | 1/2004 | Wang |
| 6,676,579 | B1 | 1/2004 | Lin |
| 6,679,816 | B1 | 1/2004 | Krull |
| 6,679,820 | B2 | 1/2004 | Barkus et al. |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,019 | B2 | 2/2004 | Ohrt et al. |
| 6,695,694 | B2 | 2/2004 | Ishikawa et al. |
| 6,698,110 | B1 | 3/2004 | Robbins |
| 6,699,159 | B2 | 3/2004 | Rouse |
| 6,699,162 | B2 | 3/2004 | Chen |
| 6,702,719 | B1 | 3/2004 | Brown et al. |
| 6,705,977 | B1 | 3/2004 | Ziak |
| 6,708,427 | B2 | 3/2004 | Sussmann et al. |
| 6,712,737 | B1 | 3/2004 | Nusbaum |
| 6,716,142 | B2 | 4/2004 | Kuo |
| 6,716,144 | B1 | 4/2004 | Shifferaw |
| 6,719,667 | B2 | 4/2004 | Wong et al. |

(56) References Cited

U.S. PATENT DOCUMENTS

| | | | |
|---|---|---|---|
| 6,719,669 | B1 | 4/2004 | Wang |
| 6,723,413 | B2 | 4/2004 | Walters |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,738,274 | B2 | 5/2004 | Prasad et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,371 | B1 | 6/2004 | Brown et al. |
| 6,747,427 | B1 | 6/2004 | Carson |
| 6,749,540 | B1 | 6/2004 | Pasero et al. |
| 6,749,542 | B2 | 6/2004 | Wu |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,482 | B2 | 8/2004 | Oglesby et al. |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,927 | B2 | 9/2004 | Toyama |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,830,540 | B2 | 12/2004 | Watterson et al. |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,846,272 | B2 | 1/2005 | Rosenow et al. |
| 6,849,032 | B2 | 2/2005 | Chu |
| 6,852,068 | B2 | 2/2005 | Ogawa |
| 6,855,093 | B2 | 2/2005 | Anderson et al. |
| 6,855,097 | B2 | 2/2005 | Krull |
| 6,857,993 | B2 | 2/2005 | Yeh |
| 6,860,836 | B1 | 3/2005 | Wu |
| 6,860,839 | B1 | 3/2005 | Dice |
| 6,872,168 | B2 | 3/2005 | Wang et al. |
| 6,872,175 | B2 | 3/2005 | Lin |
| 6,875,157 | B1 | 4/2005 | Wang |
| 6,875,160 | B2 | 4/2005 | Watterson et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,887,185 | B1 | 5/2005 | Kuo |
| 6,887,190 | B1 | 5/2005 | Azari |
| 6,893,383 | B1 | 5/2005 | Chang et al. |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,446 | B2 | 6/2005 | Greenland |
| 6,908,416 | B2 | 6/2005 | Mercado et al. |
| 6,908,417 | B2 | 6/2005 | Jackson |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,939,271 | B1 | 9/2005 | Whan-Tong et al. |
| 6,944,294 | B2 | 9/2005 | Tsay |
| 6,945,912 | B2 | 9/2005 | Levi |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,964,632 | B1 | 11/2005 | Ko |
| 6,966,872 | B2 | 11/2005 | Eschenbach |
| 6,974,404 | B1 | 12/2005 | Watterson et al. |
| 6,976,698 | B2 | 12/2005 | Kuiken |
| 6,979,283 | B2 | 12/2005 | Pan |
| 6,991,588 | B1 | 1/2006 | Adams |
| 6,994,306 | B1 | 2/2006 | Sweere et al. |
| 6,994,657 | B1 | 2/2006 | Eschenbach |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,022,048 | B1 | 4/2006 | Fernandez |
| 7,022,049 | B2 | 4/2006 | Ryan et al. |
| 7,022,051 | B2 | 4/2006 | Ota |
| 7,032,870 | B2 | 4/2006 | Sweere et al. |
| 7,033,176 | B2 | 4/2006 | Feldman |
| 7,033,306 | B2 | 4/2006 | Graber |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,891 | B1 | 5/2006 | Rivera |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,070,542 | B2 | 7/2006 | Reyes et al. |
| 7,070,545 | B2 | 7/2006 | Lull et al. |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,086,994 | B2 | 8/2006 | Turak et al. |
| 7,090,621 | B2 | 8/2006 | Loane |
| 7,090,622 | B2 | 8/2006 | Hetrick |
| 7,097,591 | B2 | 8/2006 | Moon |
| 7,097,593 | B2 | 8/2006 | Chang |

(56) References Cited

U.S. PATENT DOCUMENTS

| | | | |
|---|---|---|---|
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,641 | B2 | 9/2006 | Pertegaz-Esteban |
| 7,108,659 | B2 | 9/2006 | Ross et al. |
| 7,115,073 | B2 | 10/2006 | Nizamuddin |
| 7,125,371 | B2 | 10/2006 | Henderson |
| 7,132,939 | B2 | 11/2006 | Tyndall et al. |
| 7,140,626 | B1 | 11/2006 | Keay |
| 7,141,008 | B2 | 11/2006 | Krull et al. |
| 7,156,776 | B2 | 1/2007 | Maser |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,172,531 | B2 | 2/2007 | Rodgers, Jr. |
| 7,175,193 | B2 | 2/2007 | Wu |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,186,189 | B2 | 3/2007 | Huang |
| 7,192,387 | B2 | 3/2007 | Mendel |
| 7,192,388 | B2 | 3/2007 | Dalebout et al. |
| 7,195,568 | B2 | 3/2007 | Huang |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,211,029 | B2 | 5/2007 | Kau |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,216 | B1 | 5/2007 | McBride |
| 7,225,694 | B2 | 6/2007 | Said |
| 7,226,402 | B1 | 6/2007 | Joya |
| 7,235,942 | B2 | 6/2007 | Nagaoka et al. |
| 7,238,147 | B2 | 7/2007 | Mills et al. |
| 7,247,128 | B2 | 7/2007 | Oga |
| 7,250,022 | B2 | 7/2007 | Dalebout |
| 7,257,468 | B1 | 8/2007 | Costa et al. |
| 7,258,651 | B2 | 8/2007 | Clarke |
| 7,264,554 | B2 | 9/2007 | Bentley |
| 7,269,038 | B2 | 9/2007 | Shekhawat |
| 7,278,934 | B2 | 10/2007 | McBride et al. |
| 7,278,955 | B2 | 10/2007 | Giannelli et al. |
| 7,278,966 | B2 | 10/2007 | Hjelt et al. |
| 7,279,868 | B2 | 10/2007 | Lanni |
| 7,285,075 | B2 | 10/2007 | Cutler et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,292,151 | B2 | 11/2007 | Ferguson |
| 7,293,510 | B1 | 11/2007 | Siao |
| 7,294,094 | B1 | 11/2007 | Howle |
| 7,294,100 | B2 | 11/2007 | Bull |
| 7,303,508 | B2 | 12/2007 | Toyama et al. |
| 7,303,510 | B2 | 12/2007 | Gebhardt |
| 7,311,640 | B2 | 12/2007 | Baatz |
| 7,316,633 | B2 | 1/2008 | Liao et al. |
| 7,319,457 | B2 | 1/2008 | Lin et al. |
| 7,322,907 | B2 | 1/2008 | Bowser |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,147 | B2 | 2/2008 | Jones |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,758 | B2 | 4/2008 | Polk, III |
| 7,359,121 | B2 | 4/2008 | French et al. |
| 7,361,125 | B2 | 4/2008 | Webber et al. |
| 7,364,538 | B2 | 4/2008 | Aucamp |
| 7,366,921 | B2 | 4/2008 | Ranganathan |
| 7,367,926 | B2 | 5/2008 | Clark |
| 7,369,121 | B2 | 5/2008 | Lane |
| 7,374,522 | B2 | 5/2008 | Arnold |
| 7,377,881 | B2 | 5/2008 | Moon |
| 7,384,013 | B2 | 6/2008 | Yen |
| 7,393,308 | B1 | 7/2008 | Huang |
| 7,402,145 | B1 | 7/2008 | Woggon |
| 7,413,532 | B1 | 8/2008 | Monsrud et al. |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,455,621 | B1 | 11/2008 | Anthony |
| 7,455,626 | B2 | 11/2008 | Trevino et al. |
| 7,455,628 | B1 | 11/2008 | Stearns |
| 7,470,234 | B1 | 12/2008 | Elhag et al. |
| 7,475,613 | B2 | 1/2009 | Bailey |
| 7,488,277 | B1 | 2/2009 | Knapp |
| 7,494,450 | B2 | 2/2009 | Solomon |
| 7,497,784 | B2 | 3/2009 | Henry |
| 7,507,187 | B2 | 3/2009 | Dyer et al. |
| 7,507,189 | B2 | 3/2009 | Krull |
| 7,510,511 | B2 | 3/2009 | Von Detten |
| 7,517,303 | B2 | 4/2009 | Crawford et al. |
| 7,520,840 | B2 | 4/2009 | Shifferaw |
| 7,524,272 | B2 | 4/2009 | Bruck et al. |
| 7,525,293 | B1 | 4/2009 | Notohamiprodjo et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,540,828 | B2 | 6/2009 | Watterson et al. |
| 7,540,829 | B1 | 6/2009 | Chen |
| 7,544,153 | B2 | 6/2009 | Trevino et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,569,000 | B2 | 8/2009 | Wang |
| 7,569,004 | B2 | 8/2009 | Kolomeir |
| 7,575,537 | B2 | 8/2009 | Ellis |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,591,770 | B2 | 9/2009 | Stewart et al. |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,601,101 | B2 | 10/2009 | Jackson et al. |
| 7,602,301 | B1 | 10/2009 | Stirling et al. |
| 7,604,571 | B2 | 10/2009 | Wilkins |
| 7,604,572 | B2 | 10/2009 | Stanford |
| 7,604,573 | B2 | 10/2009 | Dalebout et al. |
| 7,608,015 | B2 | 10/2009 | Radow |
| 7,608,021 | B1 | 10/2009 | Nalley |
| 7,608,023 | B2 | 10/2009 | Casagrande |
| 7,614,639 | B2 | 11/2009 | Tholkes et al. |
| 7,614,981 | B2 | 11/2009 | Cao |
| 7,618,346 | B2 | 11/2009 | Crawford et al. |
| 7,618,350 | B2 | 11/2009 | Dalebout et al. |
| 7,621,850 | B2 | 11/2009 | Piaget et al. |
| 7,621,855 | B1 | 11/2009 | Krull |
| 7,625,314 | B2 | 12/2009 | Ungari |
| 7,628,730 | B1 | 12/2009 | Watterson et al. |
| 7,628,732 | B1 | 12/2009 | Porszasz et al. |

(56) References Cited

U.S. PATENT DOCUMENTS

| | | | |
|---|---|---|---|
| 7,637,847 | B1 | 12/2009 | Hickman |
| 7,637,850 | B2 | 12/2009 | Lin |
| 7,639,520 | B1 | 12/2009 | Zansky et al. |
| 7,645,212 | B2 | 1/2010 | Ashby et al. |
| 7,645,214 | B2 | 1/2010 | Lull |
| 7,645,218 | B2 | 1/2010 | Potok et al. |
| 7,647,196 | B2 | 1/2010 | Kahn et al. |
| 7,648,446 | B2 | 1/2010 | Chiles et al. |
| 7,651,442 | B2 | 1/2010 | Carlson |
| 7,654,229 | B2 | 2/2010 | Smith |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,670,263 | B2 | 3/2010 | Ellis |
| 7,674,205 | B2 | 3/2010 | Dalebout et al. |
| 7,674,206 | B2 | 3/2010 | Jones |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,690,556 | B1 | 4/2010 | Kahn et al. |
| 7,695,409 | B2 | 4/2010 | Helie et al. |
| 7,704,191 | B2 | 4/2010 | Smith et al. |
| 7,704,192 | B2 | 4/2010 | Dyer et al. |
| 7,708,668 | B2 | 5/2010 | Rodgers, Jr. |
| 7,708,672 | B2 | 5/2010 | Gibson et al. |
| 7,713,172 | B2 | 5/2010 | Lo |
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,722,503 | B1 | 5/2010 | Smith et al. |
| 7,722,509 | B2 | 5/2010 | Eder |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,740,563 | B2 | 6/2010 | Dalebout et al. |
| 7,745,716 | B1 | 6/2010 | Murphy |
| 7,749,137 | B2 | 7/2010 | Watt et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,762,952 | B2 | 7/2010 | Lee et al. |
| 7,766,797 | B2 | 8/2010 | Dalebout |
| 7,771,319 | B1 | 8/2010 | Lannon |
| 7,771,320 | B2 | 8/2010 | Riley et al. |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,780,578 | B2 | 8/2010 | Packham |
| 7,789,800 | B1 | 9/2010 | Watterson et al. |
| 7,794,363 | B2 | 9/2010 | Wang |
| 7,795,824 | B2 | 9/2010 | Shen et al. |
| 7,806,780 | B1 | 10/2010 | Plunkett |
| 7,806,805 | B2 | 10/2010 | Barufka et al. |
| 7,811,209 | B2 | 10/2010 | Crawford et al. |
| 7,815,549 | B2 | 10/2010 | Crawford et al. |
| 7,815,550 | B2 | 10/2010 | Watterson et al. |
| 7,815,554 | B2 | 10/2010 | Gibson et al. |
| 7,837,161 | B2 | 11/2010 | Chase |
| 7,837,595 | B2 | 11/2010 | Rice |
| 7,839,058 | B1 | 11/2010 | Churchill et al. |
| 7,846,070 | B2 | 12/2010 | Oglesby et al. |
| 7,854,669 | B2 | 12/2010 | Marty et al. |
| 7,862,483 | B2 | 1/2011 | Hendrickson et al. |
| 7,871,355 | B2 | 1/2011 | Yeh |
| 7,871,357 | B2 | 1/2011 | Gibson et al. |
| 7,878,950 | B1 | 2/2011 | Bastian |
| 7,883,448 | B2 | 2/2011 | Wang |
| 7,887,465 | B2 | 2/2011 | Uffelman |
| 7,892,148 | B1 | 2/2011 | Stauffer et al. |
| 7,892,149 | B2 | 2/2011 | Wu |
| 7,892,150 | B1 | 2/2011 | Colley |
| 7,901,325 | B2 | 3/2011 | Henderson |
| 7,908,981 | B2 | 3/2011 | Agee |
| 7,914,420 | B2 | 3/2011 | Daly et al. |
| 7,914,421 | B2 | 3/2011 | Weier et al. |
| 7,919,950 | B2 | 4/2011 | Uno et al. |
| 7,922,635 | B2 | 4/2011 | Lull et al. |
| 7,927,253 | B2 | 4/2011 | Vincent |
| 7,931,563 | B2 | 4/2011 | Shaw et al. |
| 7,938,751 | B2 | 5/2011 | Nicolas et al. |
| 7,938,755 | B1 | 5/2011 | Dyer et al. |
| 7,942,783 | B2 | 5/2011 | Ochi |
| 7,942,788 | B2 | 5/2011 | Wu |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,959,124 | B2 | 6/2011 | Phifer et al. |
| 7,972,249 | B1 | 7/2011 | Napalan |
| 7,976,437 | B1 | 7/2011 | Von Detten |
| 7,978,081 | B2 | 7/2011 | Shears et al. |
| 7,985,164 | B2 | 7/2011 | Ashby |
| 7,988,600 | B2 | 8/2011 | Rodgers, Jr. |
| 8,001,472 | B2 | 8/2011 | Gilley et al. |
| 8,002,674 | B2 | 8/2011 | Piaget et al. |
| 8,002,684 | B2 | 8/2011 | Laurent |
| 8,007,409 | B2 | 8/2011 | Elllis |
| 8,012,067 | B2 | 9/2011 | Joannou |
| 8,012,068 | B1 | 9/2011 | Malcolm |
| 8,029,415 | B2 | 10/2011 | Ashby et al. |
| 8,043,173 | B2 | 10/2011 | Menalagha et al. |
| 8,047,965 | B2 | 11/2011 | Shea |
| 8,047,966 | B2 | 11/2011 | Dorogusker et al. |
| 8,047,970 | B2 | 11/2011 | Nalley |
| 8,055,469 | B2 | 11/2011 | Kulach et al. |
| 8,057,368 | B1 | 11/2011 | Lyszczarz |
| 8,062,196 | B1 | 11/2011 | Khubani |
| 8,066,514 | B2 | 11/2011 | Clarke |
| 8,079,939 | B1 | 12/2011 | Wang |
| 8,082,029 | B2 | 12/2011 | Honda |
| 8,083,693 | B1 | 12/2011 | McKeon et al. |
| 8,103,379 | B2 | 1/2012 | Biba et al. |
| 8,104,411 | B2 | 1/2012 | Fenton |
| 8,105,213 | B2 | 1/2012 | Stewart et al. |
| 8,109,858 | B2 | 2/2012 | Redmann |
| 8,113,994 | B2 | 2/2012 | Piaget et al. |
| 8,123,527 | B2 | 2/2012 | Holljes |
| 8,141,276 | B2 | 3/2012 | Ellis |
| 8,147,385 | B2 | 4/2012 | Crawford et al. |
| 8,162,804 | B2 | 4/2012 | Tagliabue |
| 8,172,729 | B2 | 5/2012 | Ellis |
| 8,177,688 | B2 | 5/2012 | Burnfield et al. |
| 8,182,399 | B2 | 5/2012 | Davis et al. |
| 8,188,700 | B2 | 5/2012 | Tseng et al. |
| 8,200,323 | B2 | 6/2012 | Dibenedetto et al. |
| 8,221,290 | B2 | 7/2012 | Vincent et al. |
| 8,240,430 | B2 | 8/2012 | Downey |
| 8,241,187 | B2 | 8/2012 | Moon et al. |
| 8,251,874 | B2 | 8/2012 | Ashby et al. |
| 8,260,858 | B2 | 9/2012 | Belz et al. |
| 8,272,996 | B2 | 9/2012 | Weier |
| 8,275,265 | B2 | 9/2012 | Kobyakov et al. |
| 8,280,259 | B2 | 10/2012 | George et al. |
| 8,287,434 | B2 | 10/2012 | Zavadsky et al. |
| 8,306,635 | B2 | 11/2012 | Pryor |
| 8,315,823 | B2 | 11/2012 | Berme et al. |
| 8,320,578 | B2 | 11/2012 | Kahn et al. |
| 8,323,157 | B2 | 12/2012 | Campanaro et al. |
| 8,333,681 | B2 | 12/2012 | Schmidt |
| 8,343,016 | B1 | 1/2013 | Astilean |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,378,647 | B2 | 2/2013 | Yonezawa et al. |
| 8,394,005 | B2 | 3/2013 | Solow et al. |
| 8,395,366 | B2 | 3/2013 | Uno |

(56) References Cited

U.S. PATENT DOCUMENTS

| | | | |
|---|---|---|---|
| 8,435,160 | B1 | 5/2013 | Clum |
| 8,446,275 | B2 | 5/2013 | Utter, II |
| 8,449,620 | B2 | 5/2013 | Hakansson et al. |
| 8,454,437 | B2 | 6/2013 | Dugan |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,944 | B2 | 7/2013 | Drazan |
| 8,485,945 | B2 | 7/2013 | Leonhard |
| 8,487,759 | B2 | 7/2013 | Hill |
| 8,505,597 | B2 | 8/2013 | Sharperson |
| 8,506,370 | B2 | 8/2013 | Homsi |
| 8,512,210 | B2 | 8/2013 | Shauli |
| 8,516,723 | B2 | 8/2013 | Ferrigan et al. |
| 8,535,247 | B2 | 9/2013 | Williams |
| 8,540,560 | B2 | 9/2013 | Crowley et al. |
| 8,550,962 | B2 | 10/2013 | Piaget et al. |
| 8,562,489 | B2 | 10/2013 | Burton et al. |
| 8,573,982 | B1 | 11/2013 | Chuang |
| 8,602,951 | B2 | 12/2013 | Morris |
| 8,608,624 | B2 | 12/2013 | Shabodyash et al. |
| 8,614,595 | B2 | 12/2013 | Acatrinei |
| 8,614,902 | B2 | 12/2013 | Pansier et al. |
| 8,617,008 | B2 | 12/2013 | Marty et al. |
| 8,655,004 | B2 | 2/2014 | Prest et al. |
| 8,657,724 | B2 | 2/2014 | Yang |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,708,870 | B2 | 4/2014 | Nalley |
| 8,734,157 | B1 | 5/2014 | Hummel, III |
| 8,734,301 | B2 | 5/2014 | Remelius |
| 8,734,302 | B2 | 5/2014 | Hsieh |
| 8,740,756 | B2 | 6/2014 | Shabodyash et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,764,609 | B1 | 7/2014 | Elahmadie |
| 8,777,820 | B2 | 7/2014 | Lo |
| 8,783,326 | B1 | 7/2014 | Vaninger et al. |
| 8,784,274 | B1 | 7/2014 | Chuang |
| 8,790,222 | B2 | 7/2014 | Burger |
| 8,801,581 | B2 | 8/2014 | Lai et al. |
| 8,824,697 | B2 | 9/2014 | Christoph |
| 8,825,445 | B2 | 9/2014 | Hoffman et al. |
| 8,847,988 | B2 | 9/2014 | Geisner et al. |
| 8,851,565 | B2 | 10/2014 | Hontz et al. |
| 8,864,627 | B2 | 10/2014 | Bayerlein et al. |
| 8,876,661 | B2 | 11/2014 | Lu |
| 8,888,660 | B1 | 11/2014 | Oteman |
| 8,894,551 | B2 | 11/2014 | Kerdjoudj |
| 8,920,291 | B2 | 12/2014 | Chen et al. |
| 8,926,475 | B2 | 1/2015 | Lin et al. |
| 8,926,479 | B2 | 1/2015 | Chen et al. |
| 8,956,290 | B2 | 2/2015 | Gilley et al. |
| 8,956,715 | B2 | 2/2015 | Kim |
| 8,968,163 | B1 | 3/2015 | Vidmar |
| 8,979,709 | B2 | 3/2015 | Toback et al. |
| 8,986,165 | B2 | 3/2015 | Ashby |
| 9,005,085 | B2 | 4/2015 | Astilean |
| 9,011,291 | B2 | 4/2015 | Birrell |
| 9,015,952 | B2 | 4/2015 | Magosaki |
| 9,028,368 | B2 | 5/2015 | Ashby et al. |
| 9,038,218 | B1 | 5/2015 | Heil et al. |
| 9,039,578 | B2 | 5/2015 | Dalebout |
| 9,050,491 | B2 | 6/2015 | Gordon et al. |
| 9,050,498 | B2 | 6/2015 | Lu et al. |
| 9,072,932 | B2 | 7/2015 | Piaget et al. |
| 9,089,732 | B2 | 7/2015 | Andon et al. |
| 9,095,740 | B2 | 8/2015 | Wu |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,132,051 | B2 | 9/2015 | Heil |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,162,102 | B1 | 10/2015 | Eder et al. |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,220,940 | B2 | 12/2015 | Al Kuwari |
| 9,221,545 | B2 | 12/2015 | Popescu et al. |
| 9,224,291 | B2 | 12/2015 | Moll-Carrillo et al. |
| 9,226,692 | B2 | 1/2016 | Haas |
| 9,289,063 | B2 | 3/2016 | Baugh et al. |
| 9,308,415 | B2 | 4/2016 | Crawford et al. |
| 9,311,802 | B1 | 4/2016 | Chin et al. |
| 9,333,388 | B2 | 5/2016 | Lee et al. |
| 9,339,681 | B1 | 5/2016 | Nalley |
| 9,339,683 | B2 | 5/2016 | Dilli et al. |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,422 | B2 | 6/2016 | Brontman |
| 9,364,706 | B2 | 6/2016 | Lo |
| 9,364,708 | B2 | 6/2016 | Luger et al. |
| 9,364,714 | B2 | 6/2016 | Koduri et al. |
| 9,367,668 | B2 | 6/2016 | Flynt et al. |
| 9,370,687 | B2 | 6/2016 | Hao |
| 9,387,387 | B2 | 7/2016 | Dalebout |
| 9,389,718 | B1 | 7/2016 | Letourneur |
| 9,409,050 | B2 | 8/2016 | Mintz |
| 9,415,257 | B2 | 8/2016 | Habing |
| 9,452,315 | B1 | 9/2016 | Murray et al. |
| 9,452,320 | B2 | 9/2016 | Yang |
| 9,455,784 | B2 | 9/2016 | Cune et al. |
| 9,457,224 | B2 | 10/2016 | Giannelli et al. |
| 9,463,349 | B1 | 10/2016 | Chang |
| 9,480,874 | B2 | 11/2016 | Cutler |
| 9,486,658 | B2 | 11/2016 | Alexander |
| 9,498,671 | B1 | 11/2016 | Softky |
| 9,505,241 | B2 | 11/2016 | Lyon |
| 9,539,458 | B1 | 1/2017 | Ross |
| 9,540,071 | B2 | 1/2017 | Jordan et al. |
| 9,540,174 | B2 | 1/2017 | Josserond et al. |
| 9,560,917 | B2 | 2/2017 | Roslund, Jr. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,976 | B2 | 2/2017 | Chin et al. |
| 9,604,099 | B2 | 3/2017 | Taylor |
| 9,610,475 | B1 | 4/2017 | DeKnock et al. |
| 9,623,286 | B1 | 4/2017 | Chen |
| 9,673,904 | B2 | 6/2017 | Palanisamy et al. |
| 9,681,313 | B2 | 6/2017 | Malach |
| 9,682,306 | B2 | 6/2017 | Lin et al. |
| 9,694,234 | B2 | 7/2017 | Dalebout et al. |
| 9,700,780 | B2 | 7/2017 | Riley et al. |
| 9,707,441 | B2 | 7/2017 | Yang |
| 9,707,447 | B1 | 7/2017 | Lopez Babodilla |
| 9,731,158 | B1 | 8/2017 | Lo |
| 9,737,747 | B1 | 8/2017 | Walsh et al. |
| 9,757,605 | B2 | 9/2017 | Olson et al. |
| 9,764,184 | B2 | 9/2017 | Kueker et al. |
| 9,776,039 | B1 | 10/2017 | Xu |
| 9,782,625 | B1 | 10/2017 | Blum et al. |
| 9,795,827 | B2 | 10/2017 | Wiener et al. |
| 9,808,673 | B2 | 11/2017 | Robinson |
| 9,814,927 | B2 | 11/2017 | Forystek |
| 9,814,929 | B2 | 11/2017 | Moser |
| 9,814,930 | B2 | 11/2017 | Manzke et al. |

(56) References Cited

U.S. PATENT DOCUMENTS 9,827,458 B2 11/2017 Dalton
9,829,068 B2 11/2017 Marchetti
9,833,658 B2 12/2017 Wiener et al.
9,849,330 B2 12/2017 Lagree
9,889,334 B2 2/2018 Ashby et al.
9,901,767 B2 2/2018 Kuo
9,901,780 B2 2/2018 DeLuca et al.
9,901,805 B2 2/2018 Hughes, Jr.
9,914,011 B2 3/2018 Downey et al.
9,914,014 B2 3/2018 Lagree et al.
9,937,375 B2 4/2018 Zhu
9,943,719 B2 4/2018 Smith et al.
9,948,349 B2 4/2018 Malach
9,950,209 B2 4/2018 Yim et al.
9,956,450 B2 5/2018 Bayerlein et al.
9,968,821 B2 5/2018 Finlayson et al.
9,968,823 B2 5/2018 Cutler
9,987,513 B2 6/2018 Yim et al.
9,987,517 B1 6/2018 Kuo
9,993,680 B2 6/2018 Gordon
10,004,940 B2 6/2018 Badarneh
10,022,590 B2 7/2018 Foley et al.
2001/0001303 A1 5/2001 Ohsuga et al.
2001/0008053 A1 7/2001 Belli
2001/0049470 A1 12/2001 Mault et al.
2001/0051564 A1 12/2001 Iund
2002/0016235 A1 2/2002 Ashby et al.
2002/0019298 A1 2/2002 Eschenbach
2002/0024521 A1 2/2002 Goden
2002/0025888 A1 2/2002 Germanton
2002/0026130 A1 2/2002 West
2002/0039952 A1 4/2002 Clem
2002/0043909 A1 4/2002 Nielsen
2002/0045519 A1 4/2002 Watterson
2002/0055418 A1 5/2002 Pyles et al.
2002/0055419 A1 5/2002 Hinnebusch
2002/0055420 A1 5/2002 Stearns et al.
2002/0055422 A1 5/2002 Airmet
2002/0077221 A1 6/2002 Dalebout et al.
2002/0094914 A1 7/2002 Maresh et al.
2002/0107058 A1 8/2002 Namba et al.
2002/0115536 A1 8/2002 Hojo
2002/0128127 A1 9/2002 Chen
2002/0147078 A1 10/2002 Wu
2002/0151413 A1 10/2002 Dalebout
2002/0160883 A1 10/2002 Dugan
2002/0171070 A1 11/2002 Shim
2002/0198084 A1 12/2002 Stearns et al.
2003/0032524 A1 2/2003 Lamar et al.
2003/0032535 A1 2/2003 Wang
2003/0045406 A1 3/2003 Stone
2003/0060344 A1 3/2003 David
2003/0069108 A1 4/2003 Kaiserman et al.
2003/0073545 A1 4/2003 Liu
2003/0092532 A1 5/2003 Giannelli et al.
2003/0092540 A1 5/2003 Gillen
2003/0096675 A1 5/2003 Wang
2003/0097878 A1 5/2003 Farringdon et al.
2003/0104908 A1 6/2003 Tung
2003/0119635 A1 6/2003 Arbuckle
2003/0128186 A1 7/2003 Laker
2003/0134718 A1 7/2003 Kim
2003/0139259 A1* 7/2003 Kuo ..... A63B 22/02 482/54
2003/0148853 A1 8/2003 Alessandri
2003/0171189 A1 9/2003 Kaufman
2003/0171190 A1 9/2003 Rice
2003/0176815 A1 9/2003 Baba et al.
2003/0181289 A1 9/2003 Oscar Moavro
2003/0183027 A1 10/2003 Koch
2003/0211916 A1 11/2003 Capuano
2003/0222419 A1 12/2003 Geary
2003/0236153 A1 12/2003 Pan et al.
2004/0005958 A1 1/2004 Kamen et al.
2004/0005961 A1 1/2004 Iund
2004/0014567 A1 1/2004 Mendel
2004/0014571 A1 1/2004 Haynes
2004/0018917 A1 1/2004 Corbalis
2004/0018918 A1 1/2004 Reyes
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0029645 A1 2/2004 Chen
2004/0033865 A1 2/2004 Wu
2004/0043873 A1 3/2004 Wilkinson et al.
2004/0051392 A1 3/2004 Badarneh
2004/0053748 A1 3/2004 Lo et al.
2004/0063549 A1 4/2004 Kuo
2004/0067821 A1 4/2004 Kehrbaum
2004/0067833 A1 4/2004 Talish
2004/0082444 A1 4/2004 Golesh
2004/0092367 A1 5/2004 Corbalis
2004/0097331 A1 5/2004 Zillig
2004/0100484 A1 5/2004 Barrett
2004/0102292 A1 5/2004 Pyles et al.
2004/0103432 A1 5/2004 Barrett
2004/0114768 A1 6/2004 Luo
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0142800 A1 7/2004 Gerschefske
2004/0144626 A1 7/2004 Saeki
2004/0152566 A1 8/2004 Yeh
2004/0155622 A1 8/2004 Mayhew et al.
2004/0160336 A1 8/2004 Hoch
2004/0162189 A1 8/2004 Hickman
2004/0162191 A1 8/2004 Ercanbrack
2004/0163574 A1 8/2004 Schoenbach
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0198555 A1 10/2004 Anderson
2004/0198559 A1 10/2004 Grossi
2004/0198571 A1 10/2004 Howell et al.
2004/0224740 A1 11/2004 Ball et al.
2004/0224825 A1 11/2004 Giannelli et al.
2004/0224827 A1 11/2004 Ashley
2004/0242378 A1 12/2004 Pan
2004/0242379 A1 12/2004 Juva
2004/0242380 A1 12/2004 Kuivala
2004/0248699 A1 12/2004 Colley
2004/0254020 A1 12/2004 Dragusin
2004/0256524 A1 12/2004 Beck et al.
2004/0259689 A1 12/2004 Wilkins et al.
2004/0266587 A1 12/2004 Miller
2005/0003931 A1 1/2005 Mills et al.
2005/0008992 A1 1/2005 Westergaard et al.
2005/0009668 A1 1/2005 Savettiere
2005/0032611 A1 2/2005 Webber
2005/0037898 A1 2/2005 Chang
2005/0037904 A1 2/2005 Chang
2005/0043145 A1 2/2005 Anderson et al.
2005/0043146 A1 2/2005 Lo et al.
2005/0043155 A1 2/2005 Yannitte
2005/0049117 A1 3/2005 Rodgers
2005/0049121 A1 3/2005 Dalebout
2005/0054492 A1 3/2005 Neff
2005/0064994 A1 3/2005 Matsumoto
2005/0075213 A1 4/2005 Arick
2005/0090770 A1 4/2005 Chen
2005/0096187 A1 5/2005 Hsu
2005/0096189 A1 5/2005 Chen
2005/0107220 A1 5/2005 Wang
2005/0107226 A1 5/2005 Monda

(56) References Cited

U.S. PATENT DOCUMENTS

2005/0113158 A1 5/2005 Sterchi et al.
2005/0129903 A1 6/2005 Carr et al.
2005/0131319 A1 6/2005 Der Meer
2005/0132838 A1 6/2005 Lin
2005/0143226 A1 6/2005 Heidecke
2005/0143228 A1 6/2005 Lee
2005/0148398 A1 7/2005 Lochtefeld et al.
2005/0148439 A1 7/2005 Wu
2005/0148440 A1 7/2005 Denton
2005/0148442 A1 7/2005 Watterson
2005/0159273 A1 7/2005 Chen
2005/0164839 A1 7/2005 Watterson
2005/0170935 A1 8/2005 Manser
2005/0170936 A1 8/2005 Quinn
2005/0172311 A1 8/2005 Hjelt et al.
2005/0178210 A1 8/2005 Lanham
2005/0181347 A1 8/2005 Barnes et al.
2005/0181911 A1 8/2005 Porth
2005/0192162 A1 9/2005 Pan
2005/0196737 A1 9/2005 Mann
2005/0202934 A1 9/2005 Olrik et al.
2005/0209050 A1 9/2005 Bartels
2005/0209051 A1 9/2005 Santomassimo et al.
2005/0209062 A1 9/2005 Anderson et al.
2005/0215397 A1 9/2005 Watterson
2005/0233861 A1 10/2005 Hickman
2005/0233871 A1 10/2005 Anders
2005/0239600 A1 10/2005 Liang
2005/0239607 A1 10/2005 Chang
2005/0245370 A1 11/2005 Boland
2005/0250622 A1 11/2005 Chang
2005/0266961 A1 12/2005 Shum et al.
2005/0272562 A1 12/2005 Alessandri et al.
2005/0272577 A1 12/2005 Olson
2005/0277520 A1 12/2005 Van Waes
2005/0281963 A1 12/2005 Cook
2005/0283911 A1 12/2005 Roussy
2005/0288155 A1 12/2005 Yang
2006/0003869 A1 1/2006 Huang et al.
2006/0004265 A1 1/2006 Pulkkinen et al.
2006/0019804 A1 1/2006 Young
2006/0035757 A1 2/2006 Flick et al.
2006/0035758 A1 2/2006 Rogozinski
2006/0040797 A1 2/2006 Chang
2006/0047447 A1 3/2006 Brady et al.
2006/0053586 A1 3/2006 Chase
2006/0053587 A1 3/2006 Chase
2006/0058158 A1 3/2006 McAvoy
2006/0058162 A1 3/2006 Vieno et al.
2006/0063644 A1 3/2006 Yang
2006/0075544 A1 4/2006 Kriesel
2006/0079800 A1 4/2006 Martikka et al.
2006/0100069 A1 5/2006 Dibble et al.
2006/0100546 A1 5/2006 Silk
2006/0122035 A1 6/2006 Felix
2006/0122038 A1 6/2006 Chou Lin
2006/0122044 A1 6/2006 Ho
2006/0123814 A1 6/2006 Choi et al.
2006/0128534 A1 6/2006 Roque
2006/0135274 A1 6/2006 Henry
2006/0135322 A1 6/2006 Rocker
2006/0148622 A1 7/2006 Chen
2006/0151303 A1 7/2006 Motoda
2006/0160665 A1 7/2006 Tai
2006/0160666 A1 7/2006 Wang
2006/0166791 A1 7/2006 Liao
2006/0166799 A1 7/2006 Boland et al.
2006/0172862 A1 8/2006 Badarneh et al.
2006/0189439 A1 8/2006 Baudhuin
2006/0189440 A1 8/2006 Gravagne
2006/0189462 A1 8/2006 Pearson et al.
2006/0194679 A1 8/2006 Hatcher
2006/0199706 A1 9/2006 Wehrell
2006/0205568 A1 9/2006 Huang
2006/0217236 A1 9/2006 Watterson
2006/0217245 A1 9/2006 Golesh et al.
2006/0223680 A1 10/2006 Chang
2006/0229163 A1 10/2006 Waters
2006/0229170 A1 10/2006 Ozawa et al.
2006/0232147 A1 10/2006 Cheng
2006/0234832 A1 10/2006 Toyama et al.
2006/0240947 A1 10/2006 Qu
2006/0240951 A1 10/2006 Wang
2006/0240959 A1 10/2006 Huang
2006/0244187 A1 11/2006 Downey
2006/0247109 A1 11/2006 Powell
2006/0248965 A1 11/2006 Wyatt
2006/0252602 A1 11/2006 Brown
2006/0252608 A1 11/2006 Kang et al.
2006/0258513 A1 11/2006 Routley
2006/0258515 A1 11/2006 Kang et al.
2006/0264306 A1 11/2006 Tischler
2006/0270522 A1 11/2006 Yonehana et al.
2006/0276306 A1 12/2006 Pan et al.
2006/0279294 A1 12/2006 Cehelnik
2006/0287089 A1 12/2006 Addington et al.
2006/0287147 A1 12/2006 Kriesel
2006/0287163 A1 12/2006 Wang
2006/0288846 A1 12/2006 Logan
2007/0004561 A1 1/2007 Yoo
2007/0004562 A1 1/2007 Pan et al.
2007/0004569 A1 1/2007 Cao
2007/0006489 A1 1/2007 Case et al.
2007/0010383 A1 1/2007 Pertegaz-Esteban
2007/0015635 A1 1/2007 Donner
2007/0015636 A1 1/2007 Molter
2007/0027002 A1 2/2007 Clark et al.
2007/0037667 A1 2/2007 Gordon
2007/0038137 A1 2/2007 Arand et al.
2007/0042868 A1 2/2007 Fisher
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0054790 A1 3/2007 Dodge et al.
2007/0060449 A1 3/2007 Lo
2007/0060450 A1 3/2007 Lo
2007/0060451 A1 3/2007 Lucas
2007/0066448 A1 3/2007 Pan et al.
2007/0072748 A1 3/2007 Lee
2007/0072752 A1 3/2007 Koch
2007/0079691 A1 4/2007 Turner
2007/0087908 A1 4/2007 Pan et al.
2007/0111858 A1 5/2007 Dugan
2007/0111866 A1 5/2007 McVay et al.
2007/0117683 A1 5/2007 Ercanbrack et al.
2007/0123389 A1 5/2007 Martin
2007/0123390 A1 5/2007 Mathis
2007/0123395 A1 5/2007 Ellis
2007/0123396 A1 5/2007 Ellis
2007/0131409 A1 6/2007 Asahi
2007/0135264 A1 6/2007 Rosenberg
2007/0137331 A1 6/2007 Kachouh
2007/0142177 A1 6/2007 Simms et al.
2007/0142179 A1 6/2007 Terao et al.
2007/0142183 A1 6/2007 Chang
2007/0149363 A1 6/2007 Wang
2007/0151489 A1 7/2007 Byrne
2007/0155277 A1 7/2007 Amitai et al.
2007/0155495 A1 7/2007 Goo
2007/0161468 A1 7/2007 Yanagisawa et al.
2007/0167292 A1 7/2007 Kuo
2007/0179023 A1 8/2007 Dyer
2007/0184953 A1 8/2007 Luberski et al.
2007/0190508 A1 8/2007 Dalton
2007/0191141 A1 8/2007 Weber
2007/0191190 A1 8/2007 Kuo
2007/0197274 A1 8/2007 Dugan
2007/0197345 A1 8/2007 Wallace et al.
2007/0197353 A1 8/2007 Hundley
2007/0197920 A1 8/2007 Adams
2007/0201727 A1 8/2007 Birrell et al.
2007/0204430 A1 9/2007 Chase

(56) References Cited

U.S. PATENT DOCUMENTS

2007/0214630 A1 9/2007 Kim
2007/0219066 A1 9/2007 Wang
2007/0225119 A1 9/2007 Schenk
2007/0225120 A1 9/2007 Schenk
2007/0225126 A1 9/2007 Yoo
2007/0225127 A1 9/2007 Pan et al.
2007/0225622 A1 9/2007 Huang et al.
2007/0232455 A1 10/2007 Hanoun
2007/0232463 A1 10/2007 Wu
2007/0245612 A1 10/2007 Tresenfeld
2007/0247320 A1 10/2007 Morahan
2007/0249467 A1 10/2007 Hong et al.
2007/0270294 A1 11/2007 Sheets
2007/0270667 A1 11/2007 Coppi et al.
2007/0270726 A1 11/2007 Chou
2007/0281828 A1 12/2007 Rice
2007/0281831 A1 12/2007 Wang
2007/0284495 A1 12/2007 Charles
2007/0296313 A1 12/2007 Wang
2007/0298935 A1 12/2007 Badarneh
2007/0298937 A1 12/2007 Shah
2008/0001772 A1 1/2008 Saito
2008/0001866 A1 1/2008 Martin
2008/0004162 A1 1/2008 Chen
2008/0018211 A1 1/2008 Dye
2008/0020898 A1 1/2008 Pyles et al.
2008/0020902 A1 1/2008 Arnold
2008/0020907 A1 1/2008 Lin
2008/0026658 A1 1/2008 Kriesel
2008/0026838 A1 1/2008 Dunstan et al.
2008/0032864 A1 2/2008 Hakki
2008/0032870 A1 2/2008 Wu
2008/0032871 A1 2/2008 Yeh
2008/0039301 A1 2/2008 Halbridge
2008/0046246 A1 2/2008 Hakki
2008/0051256 A1 2/2008 Ashby et al.
2008/0057889 A1 3/2008 Jan
2008/0058169 A1 3/2008 Fox
2008/0058170 A1 3/2008 Giannascoli et al.
2008/0067302 A1 3/2008 Olivera
2008/0070756 A1 3/2008 Chu
2008/0076637 A1 3/2008 Gilley et al.
2008/0076972 A1 3/2008 Dorogusker et al.
2008/0077619 A1 3/2008 Gilley et al.
2008/0096745 A1 4/2008 Perry
2008/0103024 A1 5/2008 Habing
2008/0103034 A1 5/2008 Mihara et al.
2008/0108917 A1 5/2008 Joutras et al.
2008/0119333 A1 5/2008 Bowser
2008/0139370 A1 6/2008 Charnitski
2008/0153670 A1 6/2008 Mckirdy
2008/0153682 A1 6/2008 Chen et al.
2008/0155077 A1 6/2008 James
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0187689 A1 8/2008 Dierkens et al.
2008/0188362 A1 8/2008 Chen
2008/0190745 A1 8/2008 Taniguchi et al.
2008/0191864 A1 8/2008 Wolfson
2008/0200287 A1 8/2008 Marty et al.
2008/0200310 A1 8/2008 Tagliabue
2008/0207407 A1 8/2008 Yeh
2008/0214358 A1 9/2008 Ogg et al.
2008/0214971 A1 9/2008 Talish
2008/0216717 A1 9/2008 Jones
2008/0228110 A1 9/2008 Berme
2008/0229875 A1 9/2008 Ray
2008/0234110 A1 9/2008 Webber et al.
2008/0234111 A1 9/2008 Packham
2008/0242511 A1 10/2008 Munoz et al.
2008/0244870 A1 10/2008 Chase
2008/0245944 A1 10/2008 Chase
2008/0248926 A1 10/2008 Cole et al.
2008/0248935 A1 10/2008 Solow
2008/0250729 A1 10/2008 Kriesel
2008/0255794 A1 10/2008 Levine
2008/0279896 A1 11/2008 Heinen et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0300110 A1 12/2008 Smith et al.
2008/0300115 A1 12/2008 Erlandson
2008/0300914 A1 12/2008 Karkanias et al.
2008/0312047 A1 12/2008 Feng
2008/0318737 A1 12/2008 Chu
2009/0001831 A1 1/2009 Cho et al.
2009/0011907 A1 1/2009 Radow
2009/0023553 A1 1/2009 Shim
2009/0027925 A1 1/2009 Kanouda et al.
2009/0029831 A1 1/2009 Weier
2009/0036276 A1 2/2009 Loach
2009/0042696 A1 2/2009 Wang
2009/0042698 A1 2/2009 Wang
2009/0048073 A1 2/2009 Roimicher
2009/0048079 A1 2/2009 Nalley
2009/0048493 A1 2/2009 James et al.
2009/0053682 A1 2/2009 Stern
2009/0054214 A1 2/2009 Kadar
2009/0054751 A1 2/2009 Babashan et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0093347 A1 4/2009 Wang
2009/0100718 A1 4/2009 Gerber
2009/0105047 A1 4/2009 Guidi
2009/0105052 A1 4/2009 Dalebout et al.
2009/0105548 A1 4/2009 Bart
2009/0111664 A1 4/2009 Kau
2009/0111665 A1 4/2009 Wang
2009/0111666 A1 4/2009 Wang
2009/0111670 A1 4/2009 Williams
2009/0118098 A1 5/2009 Yeh
2009/0119032 A1 5/2009 Meyer
2009/0120208 A1 5/2009 Meyer
2009/0120210 A1 5/2009 Phillips et al.
2009/0124463 A1 5/2009 Lin
2009/0124464 A1 5/2009 Kastelic
2009/0124465 A1 5/2009 Wang
2009/0124466 A1 5/2009 Zhang
2009/0128516 A1 5/2009 Rimon et al.
2009/0144639 A1 6/2009 Nims et al.
2009/0156363 A1 6/2009 Guidi et al.
2009/0156364 A1 6/2009 Simeoni
2009/0158871 A1 6/2009 Chuo
2009/0163326 A1 6/2009 Wang
2009/0163327 A1 6/2009 Huang et al.
2009/0170667 A1 7/2009 Irving et al.
2009/0170672 A1 7/2009 Mcmullen
2009/0176625 A1 7/2009 Irving et al.
2009/0176628 A1 7/2009 Radding et al.
2009/0180646 A1 7/2009 Vulfson et al.
2009/0181829 A1 7/2009 Wu
2009/0181830 A1 7/2009 Wu
2009/0181831 A1 7/2009 Kuo
2009/0181833 A1 7/2009 Cassidy
2009/0197740 A1 8/2009 Julskjaer et al.
2009/0209393 A1 8/2009 Crater et al.
2009/0221405 A1 9/2009 Wang
2009/0221407 A1 9/2009 Hauk
2009/0227424 A1 9/2009 Hirata et al.
2009/0227432 A1 9/2009 Pacheco
2009/0230084 A1 9/2009 Yourist
2009/0240858 A1 9/2009 Takebayashi
2009/0246746 A1 10/2009 Roerdink et al.
2009/0253554 A1 10/2009 Mcintosh
2009/0258710 A1 10/2009 Quatrochi et al.

(56) References Cited

U.S. PATENT DOCUMENTS

2009/0258763 A1 10/2009 Richter
2009/0269728 A1 10/2009 Verstegen et al.
2009/0286653 A1 11/2009 Wiber
2009/0293319 A1 12/2009 Avni
2009/0312158 A1 12/2009 Trevino et al.
2010/0015585 A1 1/2010 Baker
2010/0016127 A1 1/2010 Farnsworth et al.
2010/0022354 A1 1/2010 Fisher
2010/0024590 A1 2/2010 O'neill
2010/0032533 A1 2/2010 Chen et al.
2010/0034665 A1 2/2010 Zhong et al.
2010/0035726 A1 2/2010 Fisher et al.
2010/0041516 A1 2/2010 Kodama
2010/0048358 A1 2/2010 Tchao et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0079291 A1 4/2010 Kroll et al.
2010/0081548 A1 4/2010 Labedz
2010/0087298 A1 4/2010 Zaccherini
2010/0099541 A1 4/2010 Patel
2010/0105527 A1 4/2010 Johnson
2010/0113223 A1 5/2010 Chiles et al.
2010/0125026 A1 5/2010 Zavadsky et al.
2010/0130337 A1 5/2010 Stewart
2010/0137105 A1 6/2010 McLaughlin
2010/0144501 A1 6/2010 Berhanu
2010/0156625 A1 6/2010 Ruha
2010/0167883 A1 7/2010 Grind
2010/0173276 A1 7/2010 Vasin
2010/0173755 A1 7/2010 P Erez De Lazarraga
2010/0175634 A1 7/2010 Chang et al.
2010/0184568 A1 7/2010 Schippers
2010/0190615 A1 7/2010 Baker et al.
2010/0192715 A1 8/2010 Vauchel et al.
2010/0197462 A1 8/2010 Piane, Jr.
2010/0197465 A1 8/2010 Stevenson
2010/0210418 A1 8/2010 Park
2010/0216599 A1 8/2010 Watterson
2010/0216600 A1 8/2010 Noffsinger
2010/0216607 A1 8/2010 Mueller
2010/0222179 A1 9/2010 Temple et al.
2010/0222182 A1 9/2010 Park
2010/0227740 A1 9/2010 Liu
2010/0235667 A1 9/2010 Mucignat et al.
2010/0240458 A1 9/2010 Gaiba et al.
2010/0248899 A1 9/2010 Bedell et al.
2010/0255959 A1 10/2010 Dalebout et al.
2010/0267524 A1 10/2010 Stewart et al.
2010/0279822 A1 11/2010 Ford
2010/0285933 A1 11/2010 Nalley
2010/0289466 A1 11/2010 Telefus
2010/0289772 A1 11/2010 Miller
2010/0292050 A1 11/2010 DiBenedetto et al.
2010/0304931 A1 12/2010 Stumpf
2010/0304932 A1 12/2010 Kolman et al.
2010/0311552 A1 12/2010 Sumners
2010/0320956 A1 12/2010 Lumsden et al.
2011/0003664 A1 1/2011 Richard
2011/0021319 A1 1/2011 Nissila et al.
2011/0028282 A1 2/2011 Sbragia
2011/0034300 A1 2/2011 Hall
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0073743 A1 3/2011 Shamie
2011/0077055 A1 3/2011 Pakula et al.
2011/0082013 A1 4/2011 Bastian
2011/0086707 A1 4/2011 Loveland
2011/0087137 A1 4/2011 Hanoun
2011/0087445 A1 4/2011 Sobolewski
2011/0087446 A1 4/2011 Redmond
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0112771 A1 5/2011 French
2011/0118089 A1 5/2011 Ellis
2011/0124466 A1 5/2011 Nishimura
2011/0124476 A1 5/2011 Holley
2011/0131005 A1 6/2011 Ueshima et al.
2011/0136627 A1 6/2011 Williams
2011/0143769 A1 6/2011 Jones et al.
2011/0143898 A1 6/2011 Trees
2011/0152037 A1 6/2011 Tsou
2011/0152038 A1 6/2011 Freitag
2011/0152039 A1* 6/2011 Hendrickson ..... A63B 21/0051 482/54
2011/0152635 A1 6/2011 Morris et al.
2011/0165995 A1 7/2011 Paulus
2011/0172060 A1 7/2011 Morales et al.
2011/0175744 A1 7/2011 Englert et al.
2011/0181420 A1 7/2011 Mack et al.
2011/0188269 A1 8/2011 Hosotani
2011/0197157 A1 8/2011 Hoffman et al.
2011/0199799 A1 8/2011 Hui et al.
2011/0201481 A1 8/2011 Lo
2011/0202236 A1 8/2011 Galasso et al.
2011/0205164 A1 8/2011 Hansen et al.
2011/0221672 A1 9/2011 Osterhout et al.
2011/0247530 A1 10/2011 Coffman
2011/0252597 A1 10/2011 Burris et al.
2011/0257797 A1 10/2011 Burris et al.
2011/0269517 A1 11/2011 Englert et al.
2011/0269604 A1 11/2011 Tseng
2011/0275482 A1 11/2011 Brodess et al.
2011/0275489 A1 11/2011 Apau
2011/0275499 A1 11/2011 Eschenbach
2011/0281691 A1 11/2011 Ellis
2011/0283188 A1 11/2011 Farrenkopf et al.
2011/0283231 A1 11/2011 Richstein et al.
2011/0308919 A1 12/2011 Hahn
2011/0312473 A1 12/2011 Chu et al.
2011/0319229 A1 12/2011 Corbalis et al.
2012/0004075 A1 1/2012 Kissel et al.
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0020135 A1 1/2012 McCune
2012/0021873 A1 1/2012 Brunner
2012/0021875 A1 1/2012 Karl
2012/0032896 A1 2/2012 Vesely
2012/0071301 A1 3/2012 Kaylor et al.
2012/0088633 A1 4/2012 Crafton
2012/0088634 A1 4/2012 Heidecke
2012/0088640 A1 4/2012 Wissink
2012/0116684 A1 5/2012 Ingrassia et al.
2012/0132877 A1 5/2012 Wang
2012/0133192 A1 5/2012 Simpson
2012/0165162 A1 6/2012 Lu
2012/0169603 A1 7/2012 Peterson et al.
2012/0174833 A1 7/2012 Early
2012/0178590 A1 7/2012 Lu
2012/0190502 A1 7/2012 Paulus et al.
2012/0212505 A1 8/2012 Burroughs et al.
2012/0218184 A1 8/2012 Wissmar
2012/0230504 A1 9/2012 Kuroda
2012/0242774 A1 9/2012 Numano et al.
2012/0248263 A1 10/2012 Grotenhuis
2012/0252580 A1 10/2012 Dugan
2012/0253234 A1 10/2012 Yang et al.
2012/0253489 A1 10/2012 Dugan
2012/0258433 A1 10/2012 Hope et al.
2012/0263892 A1 10/2012 Rodgers
2012/0270705 A1 10/2012 Lo
2012/0271143 A1 10/2012 Aragones et al.
2012/0277040 A1 11/2012 Vincent et al.
2012/0277891 A1 11/2012 Aragones et al.
2012/0293141 A1 11/2012 Zhang et al.

(56) References Cited

U.S. PATENT DOCUMENTS

2012/0296455 A1 11/2012 Ohnemus et al.
2012/0298017 A1 11/2012 Chen
2012/0300515 A1 11/2012 Carletti et al.
2012/0319604 A1 12/2012 Walters
2012/0326873 A1 12/2012 Utter, II
2013/0002533 A1 1/2013 Burroughs et al.
2013/0004010 A1 1/2013 Royer
2013/0009993 A1 1/2013 Horseman
2013/0018494 A1 1/2013 Amini
2013/0034671 A1 2/2013 George
2013/0035612 A1 2/2013 Mason et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053222 A1 2/2013 Lo
2013/0053990 A1 2/2013 Ackland
2013/0095959 A1 4/2013 Marty
2013/0095978 A1 4/2013 Sauter
2013/0130868 A1 5/2013 Hou
2013/0130869 A1 5/2013 Hou
2013/0139736 A1 6/2013 Flaherty
2013/0141235 A1 6/2013 Utter, II
2013/0147411 A1 6/2013 Pang et al.
2013/0150214 A1 6/2013 Wu
2013/0154441 A1 6/2013 Redmond
2013/0165297 A1 6/2013 Daly
2013/0172152 A1 7/2013 Watterson
2013/0182781 A1 7/2013 Matsutani
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0196821 A1 8/2013 Watterson et al.
2013/0196826 A1 8/2013 Colledge
2013/0196827 A1 8/2013 Chang
2013/0211858 A1 8/2013 Ohnemus et al.
2013/0228063 A1 9/2013 Turner
2013/0228422 A1 9/2013 Mathieu
2013/0231219 A1 9/2013 Huang
2013/0237383 A1 9/2013 Chen
2013/0245966 A1 9/2013 Burroughs et al.
2013/0263418 A1 10/2013 Johnson, Jr.
2013/0267386 A1 10/2013 Her
2013/0274040 A1 10/2013 Coza et al.
2013/0274069 A1 10/2013 Watterson et al.
2013/0274071 A1 10/2013 Wang
2013/0280682 A1 10/2013 Levine et al.
2013/0324368 A1 12/2013 Aragones et al.
2013/0325394 A1 12/2013 Yuen et al.
2013/0338802 A1 12/2013 Winsper et al.
2013/0346043 A1 12/2013 Mewes et al.
2014/0011645 A1 1/2014 Johnson et al.
2014/0026788 A1 1/2014 Kallio, III et al.
2014/0031703 A1 1/2014 Rayner et al.
2014/0039840 A1 2/2014 Yuen et al.
2014/0052280 A1 2/2014 Yuen et al.
2014/0056461 A1 2/2014 Afshar
2014/0073488 A1 3/2014 Wu
2014/0080678 A1 3/2014 Wu
2014/0085077 A1 3/2014 Luna et al.
2014/0100464 A1 4/2014 Kaleal et al.
2014/0102340 A1 4/2014 Kooistra
2014/0121066 A1 5/2014 Huang et al.
2014/0139450 A1 5/2014 Levesque et al.
2014/0156228 A1 6/2014 Molettiere et al.
2014/0171266 A1 6/2014 Hawkins, III et al.
2014/0187383 A1 7/2014 Martin
2014/0195103 A1 7/2014 Nassef
2014/0221160 A1 8/2014 Hardy et al.
2014/0222173 A1 8/2014 Giedwoyn et al.
2014/0265690 A1 9/2014 Henderson
2014/0270375 A1 9/2014 Canavan et al.
2014/0274564 A1 9/2014 Greenbaum
2014/0274579 A1 9/2014 Olson
2014/0358473 A1 12/2014 Goel et al.
2014/0360413 A1 12/2014 Schenk
2015/0001048 A1 1/2015 Koppes et al.
2015/0003621 A1 1/2015 Trammell
2015/0004579 A1 1/2015 Shelton
2015/0016623 A1 1/2015 Trammell
2015/0044648 A1 2/2015 White et al.
2015/0048807 A1 2/2015 Fan et al.
2015/0065273 A1 3/2015 Lake
2015/0065301 A1 3/2015 Oteman
2015/0105220 A1 4/2015 Hong
2015/0192929 A1 7/2015 Rihn et al.
2015/0199494 A1 7/2015 Koduri et al.
2015/0202487 A1 7/2015 Wu
2015/0209610 A1 7/2015 Dalebout et al.
2015/0209617 A1 7/2015 Hsiao
2015/0250304 A1 9/2015 Dalebout
2015/0251047 A1 9/2015 Maaniitty
2015/0251048 A1 9/2015 Dalebout
2015/0251055 A1 9/2015 Ashby
2015/0253210 A1 9/2015 Ashby et al.
2015/0265903 A1 9/2015 Kolen et al.
2015/0295397 A1 10/2015 Lin et al.
2015/0314184 A1 11/2015 Moya Saez
2015/0346994 A1 12/2015 Chanyontpatanakul
2015/0352396 A1 12/2015 Dalebout
2015/0352401 A1 12/2015 Johnson
2015/0352402 A1 12/2015 Arnold et al.
2015/0367158 A1 12/2015 Pretz et al.
2015/0367176 A1 12/2015 Bejestan et al.
2016/0008650 A1 1/2016 Jue et al.
2016/0016035 A1 1/2016 Hao
2016/0027325 A1 1/2016 Malhotra
2016/0038785 A1 2/2016 Netter
2016/0047446 A1 2/2016 Hung
2016/0066818 A1 3/2016 Cowley et al.
2016/0096064 A1 4/2016 Gatti
2016/0121161 A1 5/2016 Mountain
2016/0193518 A1 7/2016 Baxter
2016/0211841 A1 7/2016 Harrison
2016/0219968 A1 8/2016 Martin
2016/0263426 A1 9/2016 Mueller et al.
2016/0303421 A1 10/2016 Tyger et al.
2016/0317861 A1 11/2016 Dalebout
2016/0367851 A1 12/2016 Astilean et al.
2017/0056726 A1 3/2017 Dalebout et al.
2017/0068782 A1 3/2017 Pillai et al.
2017/0113093 A1 4/2017 Bellavista et al.
2017/0120102 A1 5/2017 Chen
2017/0128784 A1 5/2017 Molins et al.
2017/0136280 A1 5/2017 Lee
2017/0136288 A1 5/2017 Huang
2017/0136289 A1 5/2017 Frank
2017/0136291 A1 5/2017 Huang
2017/0136339 A1 5/2017 Habiche
2017/0165523 A1 6/2017 Chou
2017/0189745 A1 7/2017 Hamilton et al.
2017/0216660 A1 8/2017 Lernihan
2017/0266483 A1 9/2017 Dalebout et al.
2017/0266532 A1 9/2017 Watterson
2017/0266533 A1 9/2017 Dalebout
2017/0266534 A1 9/2017 Watterson
2017/0266535 A1 9/2017 Watterson
2017/0274242 A1 9/2017 Corbalis
2017/0326411 A1 11/2017 Watterson
2017/0340917 A1 11/2017 Chang
2017/0368442 A1 12/2017 Baudhuin
2018/0001135 A1 1/2018 Powell
2018/0056111 A1 3/2018 Chiang et al.
2018/0092603 A1 4/2018 Duan et al.
2018/0099179 A1 4/2018 Chatterton et al.
2018/0099180 A1 4/2018 Wilkinson
2018/0099181 A1 4/2018 Powell et al.
2018/0104533 A1 4/2018 Powell et al.
2018/0111018 A1 4/2018 Lee
2018/0117385 A1 5/2018 Watterson et al.
2018/0117388 A1 5/2018 Porter
2018/0117419 A1 5/2018 Jackson

(56) References Cited

U.S. PATENT DOCUMENTS

| | | | |
|---|---|---|---|
| 2018/0147440 | A1 | 5/2018 | Lin |
| 2018/0154205 | A1 | 6/2018 | Watterson |
| 2018/0154208 | A1 | 6/2018 | Powell et al. |

FOREIGN PATENT DOCUMENTS

| | | |
|---|---|---|
| TW | M333198 | 6/2008 |
| TW | M517957 | 2/2016 |

* cited by examiner

COOLING SYSTEMS AND METHODS FOR EXERCISE EQUIPMENT

RELATED APPLICATIONS

This application is a continuation-in-part of U.S. patent application Ser. No. 15/639,935 filed on 30 Jun. 2017 and titled "System and Methods for Cooling Internal Exercise Equipment Components." U.S. patent application Ser. No. 15/639,935 is herein incorporated by reference for all that it contains.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in World Intellectual Property Organization Publication No. WO/1989/07473 issued to Steven T. Sherrard, et al. In this reference, an exercise treadmill includes transverse modular components that are fixably yet slidably supported through T-slots in extruded side rails having inwardly opening T-slots. Landings integral with the side rails cover the edges of the tread belt. The bed is carried on bed rails supported on the side rails by bolts extending through the T-slots into bed slides. Transverse bed supports capped by resilient shock mounts support the center of the bed. Idler and drive rollers at opposite ends of the bed are slidably supported through the T-slots of the side rails on bearing slides. The rear idler roller is adjustably positioned by bolts engaging end caps at the rear ends of the side rails. A motor moves the tread belt over the bed and rollers. An inertial flywheel, fan and encoder wheel are mounted on the motor axle. A linear lift mechanism within the stanchion raises and lowers the treadmill. This reference also indicates that the inertial flywheel is significantly heavier than those found in other exercise treadmills to reduce the peak loads placed on the treadmill's motor. A fan recessed within the outer surface of the flywheel draws air between the spokes of the flywheel and over the air inlet grill of the motor.

SUMMARY

In one embodiment, an exercise machine includes a deck, a motor housing incorporated into the deck, a console positioned at an elevation above the motor housing, a fan associated with at least one of a lift motor and a drive motor in the motor housing, an airflow pathway extending from a location adjacent the fan through a first outlet vent located in the console to a location above the motor housing, and a mechanism configured to selectively alter airflow flowing through the airflow pathway.

The mechanism may include a clutch coupled with the fan. The clutch may include an electromagnetic clutch.

The clutch may be in a normally engaged state.

The mechanism may include a diverter.

The diverter may be displaceable between at least two different positions, including a first position wherein substantially all airflow is directed through the first outlet vent, and a second position wherein all airflow is directed through a second vent to a location away from the location above the motor housing.

The diverter may be displaceable to at least a third position wherein a first portion of the airflow is directed through the first outlet vent and a second portion of the airflow is directed through the second outlet vent.

The diverter may be placed in the first position upon starting operation of the exercise machine.

The exercise machine may include at least one post member extending from a location adjacent the deck up to the console, and wherein the airflow pathway extends through an interior portion of the at least one post member.

An inlet vent may be located in the at least one post member and be in fluid communication with the airflow pathway.

The exercise machine may include at least one auxiliary fan disposed within the airflow pathway.

The at least one auxiliary fan may be configured to begin operation upon starting operation of the exercise machine.

The exercise machine may include a flywheel where the fan is attached to the flywheel and the fan generates an airflow that directs air across the lift motor.

Generating the airflow may include pushing air towards the lift motor.

Generating the airflow may include drawing air towards the fan assembly.

The exercise machine may include a first pulley incorporated into the deck, a tread belt incorporated into the deck and in engagement with the first pulley, a drive motor in mechanical communication with the first pulley, and the flywheel being rotationally fixed with respect to the drive motor. When the drive motor causes the tread belt to move in a rotational direction and causes the flywheel to spin, the fan assembly directs air across the lift motor.

The exercise machine may include a second pulley incorporated into the deck at an opposite end of the deck than the first pulley, and the tread belt surrounds the first pulley and the second pulley.

The drive motor, flywheel, and fan assembly may be coaxial, and the fan assembly may be located adjacent to the lift motor.

The exercise machine may include a second fan connected to a second side of the flywheel, where the second fan generates a second airflow when the flywheel rotates, the second airflow being configured to pass over the drive motor.

The exercise machine may include a dump resistor connected to the drive motor where the dump resistor is positioned within the airflow generated with the fan.

The cooling mechanism may include a ring member, an annulus defined in the ring member, and at least one fan blade formed on the ring member.

When the ring member is rotating, a pressure drop may be generated within the annulus.

The exercise machine may include an annular lip formed on the circumference of the ring member and adjacent to the fan blade.

The exercise machine may include a housing and at least one vent located in a bottom side of the housing where the lift motor and the cooling mechanism are located within the housing.

In one embodiment, a fan assembly includes a ring member, a face of the ring member, an annulus defined in the ring member, and at least one fan blade formed on the face of the ring member.

When the ring member is rotating, a pressure drop may generated within the annulus.

The fan assembly may include an annular lip formed on the circumference of the ring member and adjacent to the fan blade.

The fan assembly may include the ring member that is attached to a flywheel where a pressure drop pulls intake air towards the annulus and where the flywheel and the annular lip collectively reverse the flow of the intake air away from the annulus at an angle greater than ten degrees with respect to a rotational axis of the ring member.

The fan assembly may be incorporated into a treadmill and directs an airflow across a lift motor.

In one embodiment, a method of operating an exercise machine includes providing a deck with a motor housing, providing a motor in the motor housing to alter an operating characteristic of the deck, providing a fan to circulate air over the motor, providing an airflow pathway from a location adjacent the fan, to a first exhaust vent located in a console of the exercise machine, exhausting substantially all airflow from the fan through the first exhaust vent to a location above the motor housing upon starting the exercise machine, and altering at least one characteristic of the airflow through the airflow pathway during subsequent operation of the exercise machine.

Altering at least one characteristic of the airflow may include turning off the fan.

Altering at least one characteristic of the airflow may include diverting at least a portion of the airflow through a second exhaust vent.

Altering at least one characteristic of the airflow may include diverting substantially all of the airflow through a second exhaust vent.

Altering at least one characteristic of the airflow may be responsive to a user command.

Altering at least one characteristic of the airflow is responsive to a command associated with a predefined workout program or a simulated environment.

In accordance with one embodiment, a treadmill comprises a deck, a motor housing incorporated into the deck, a first pulley incorporated into the deck, a tread belt incorporated into the deck and in engagement with the first pulley, a drive motor located within the motor housing, in mechanical communication with the first pulley, a flywheel being rotationally fixed with respect to the drive motor where the drive motor causes the tread belt to move in a rotational direction and causes the flywheel to spin, a lift motor located in the motor housing, a fan assembly that cools the lift motor, a console, at least one post member extending from a location adjacent the deck to the console, an airflow path extending from the fan, through the at least one post member, through an exhaust vent located in the console, and a mechanism configured to selectively alter airflow flowing through the airflow pathway.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length. Additionally, for purposes of this disclosure, the term "post" generally refers to an upright structural member.

Figure 1:
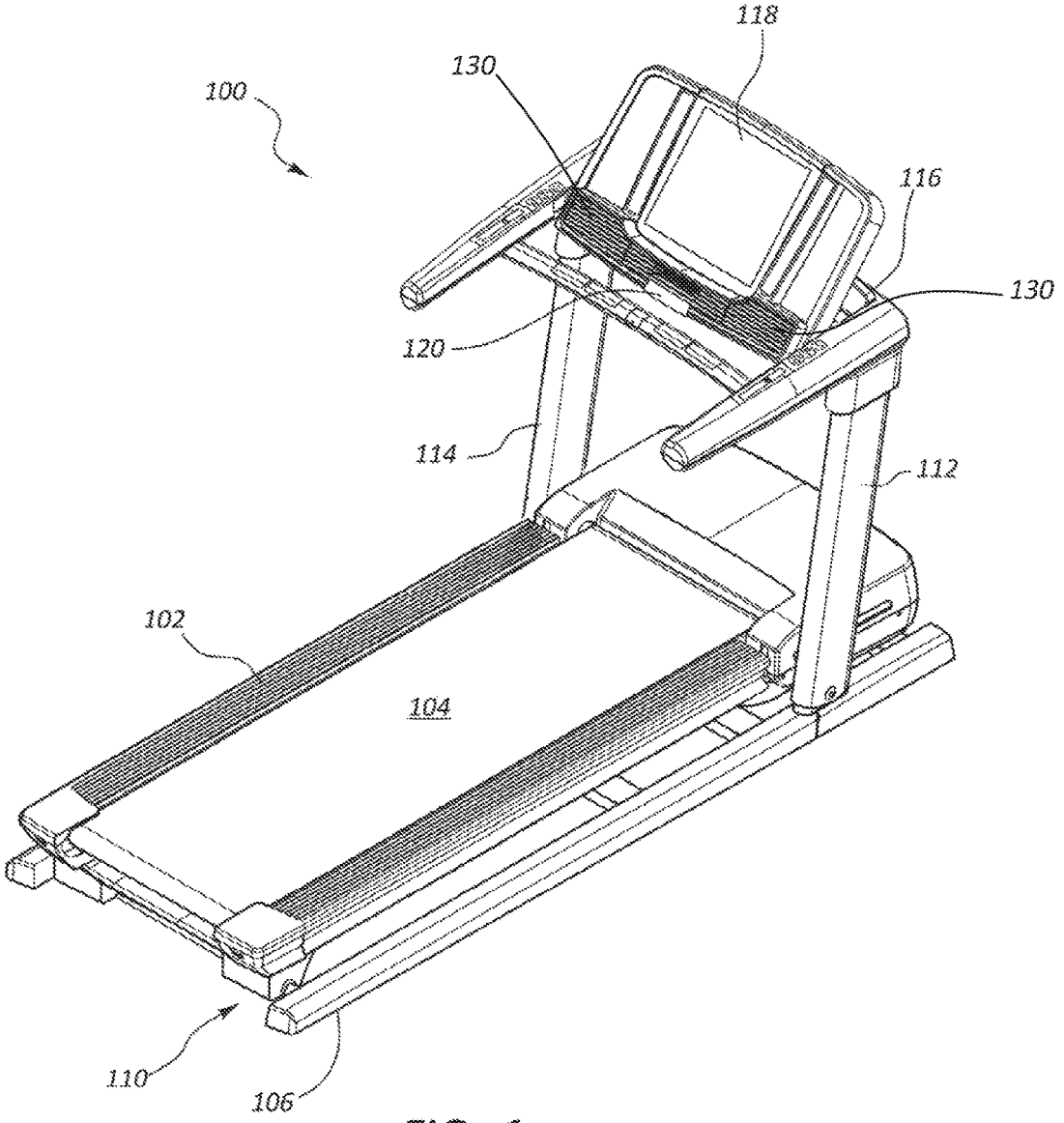
FIG. 1 depicts an example of an exercise machine in accordance with aspects of the present disclosure.

FIG. 1 depicts an example of a treadmill 100 having a deck 102 with a first pulley disposed in a front portion of the deck 102 and a second pulley incorporated into a rear portion of the deck 102. A tread belt 104 surrounds the first pulley and the second pulley. A drive motor is in mechanical communication with either the first pulley or the second pulley.

The rear portion of the deck 102 is attached to a base member 106 of the treadmill's frame. A pivot connection 110 between the rear portion of the deck 102 and the base member 106 allows the front portion of the deck 102 to incline upwards or decline downwards. When the deck 102 inclines or declines, the base member 106 remains stationary.

A first side post 112 is attached to a first side of the base member 106, and a second side post 114 is attached to a second side of the base member 106. In the example depicted in FIG. 1, the first side post 112 and the second side post 114 also remain stationary as the deck 102 inclines and/or declines. The first side post 112 and the second side post 114 collectively support a console 116. The console 116 includes a display 118 and an input mechanism 120 for controlling the deck's incline angle. A vent or other outlet 130 may also be formed in the console 116 and configured to exhaust airflow to a location above the treadmill deck 102 and onto a user during operation of the treadmill 100.

Figure 2:
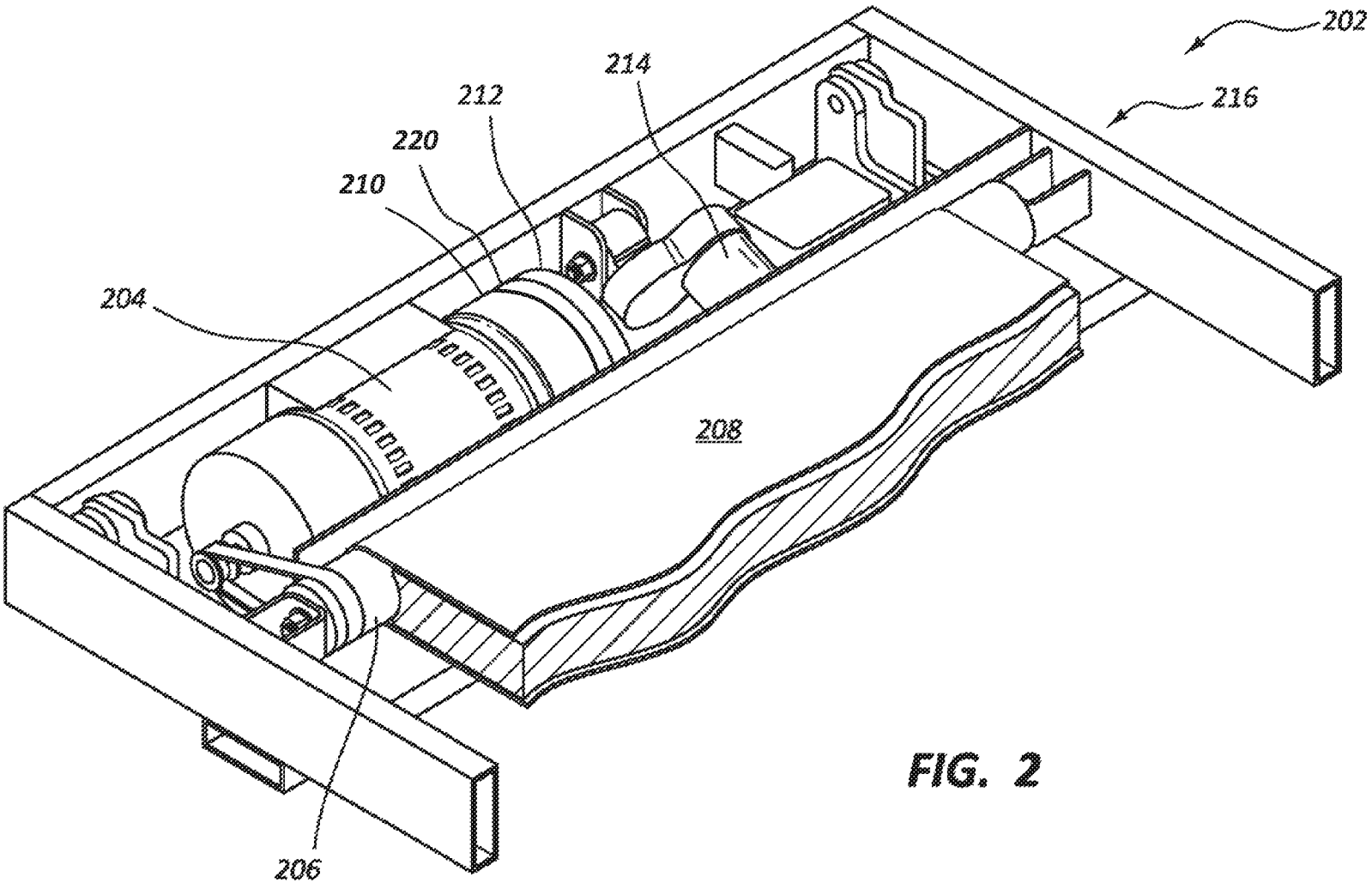
FIG. 2 depicts an example of an exercise machine in accordance with aspects of the present disclosure.

FIG. 2 illustrates an example of a treadmill 202 with a cover removed for illustrative purposes. Inside the cover, a drive motor 204 is disposed adjacent to a pulley 206 that moves the tread belt 208 in a rotational direction. Attached to and coaxial with the drive motor 204 is a flywheel 210. The flywheel 210 rotates with the drive motor 204.

A fan assembly 212 is connected to the flywheel 210 on the flywheel's side that is away from the drive motor 204. The fan assembly 212 is also coaxial with the drive motor 204. A lift motor 214 is adjacent to the fan assembly 212. The lift motor 214 is oriented so that it is connected to the deck 216 and also to the base frame (e.g., 106 in FIG. 1) of the treadmill. When activated, the lift motor 214 causes a rod to extend downward, which pushes against the front portion of the deck and the base frame causing the front portion of the deck to raise. In other situations, when the lift motor 214 is activated, the rod is retracted, which causes the front portion of the deck to lower. In these cases, the lift motor 214 may be transversely oriented with respect to the fan assembly 212.

In some cases, the lift motor 214 is located within inches of the fan assembly 212. In some situations, the lift motor 214 is located less than an inch away from the fan assembly 212. When the drive motor 204 is active, the flywheel 210 and the fan assembly 212 rotate together. The fan assembly 212 causes air to flow around the lift motor 214, which can lower the lift motor's temperature. The other components within the housing may also experience a temperature drop due to the operation of the fan assembly 212.

In some cases, a clutch mechanism 220 mechanism is placed between the flywheel 210 and the fan assembly 212. In some cases, the clutch mechanism 220 is configured to be normally engaged (meaning the fan assembly is coupled with, and rotates with, the flywheel) and can be selectively disengaged. In one example, an input mechanism (e.g., 120 in FIG. 1) may be actuated by a user to selectively disengage and/or reengage the fan assembly 212 with the flywheel 210.

Figure 3:
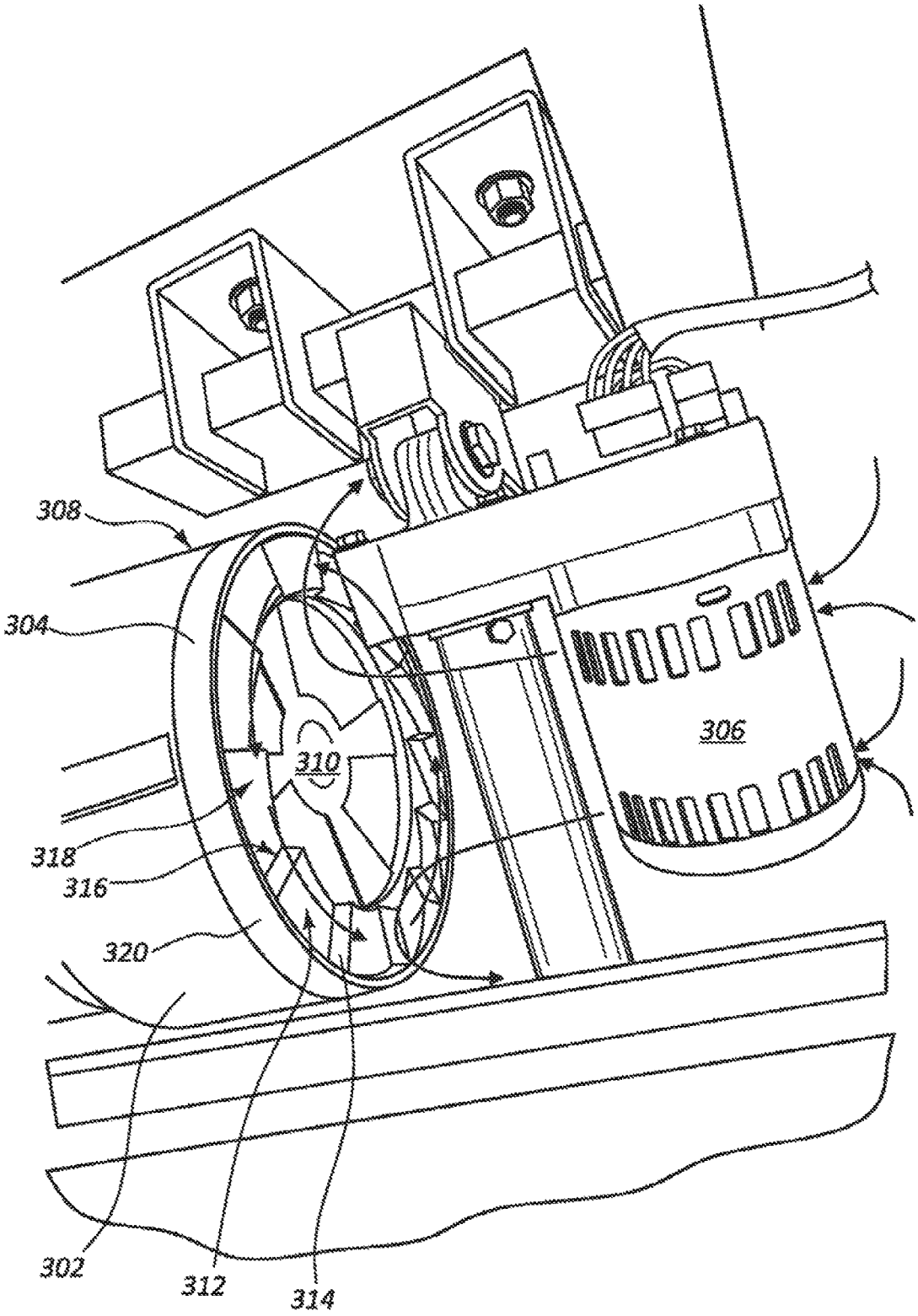
FIG. 3 depicts an example of a cooling mechanism in accordance with aspects of the present disclosure.

FIG. 3 illustrates an example of a treadmill 300 with a cover removed for illustrative purposes. The treadmill 300 includes a flywheel 302 and a fan assembly 304 attached to the flywheel 302. A lift motor 306 is located adjacent to the fan assembly 304.

In this example, the fan assembly 304 includes a ring member 308 that defines a central annulus 310. Distally located with respect to the central annulus 310, a plurality of fan blades 312 are formed in the ring member's face 314. While any appropriate type of fan blade geometry may be used, the fan blade geometry in this example includes a leading side 316 that forms an edge face that is transversely oriented with a base of the fan assembly 304. A trailing side 318 of the fan blade 312 tapers towards a base of the ring member 308 and towards an adjacent fan blade. A circumferential lip 320 is located on the circumference of the ring member 308. In this example, the circumferential lip has a height that is approximately the height of the leading side 316 of the fan blades 312.

Figure 4:
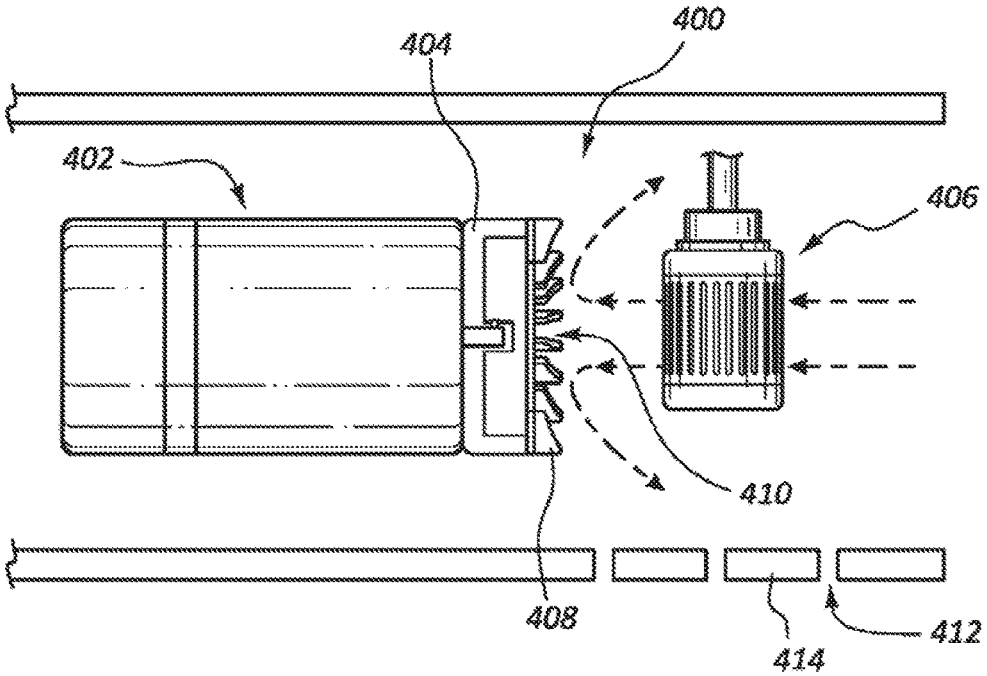
FIG. 4 depicts an example of a cooling mechanism in accordance with aspects of the present disclosure.

FIG. 4 illustrates an example of the cooling mechanism 400. In this example, the cooling mechanism 400 includes the drive motor 402, the flywheel 404, and the fan assembly 408. The lift motor 406 is located adjacent to the lift motor 406.

As the drive motor 402 rotates, the flywheel 404 and fan assembly 408 also rotate. As the fan assembly 408 rotates, a pressure drop is generated in the annulus 410 of the ring member. This pressure drop draws air creating an airflow across the lift motor 406. The fan blades of the fan assembly 408 push air outward across the leading sides of the fan blades towards the circumferential lip of the fan blade. The circumferential lip pushes the airflow forward so that the intake air reverses its direction. In some examples, the airflow is rerouted between 120 degrees to 175 degrees from the intake air's initial travel direction.

With the movement of the air generated by the fan assembly, a pressure drop may be generated behind the fan assembly and adjacent the flywheel 404. In this example, the air from behind the fan assembly 408 may be drawn into the airflow and increase the air circulation in the entire housing. Vent openings 412 may be formed in the bottom portion 414 of the housing to increase an air exchange between the inside and outside of the motor housing.

Figure 5:
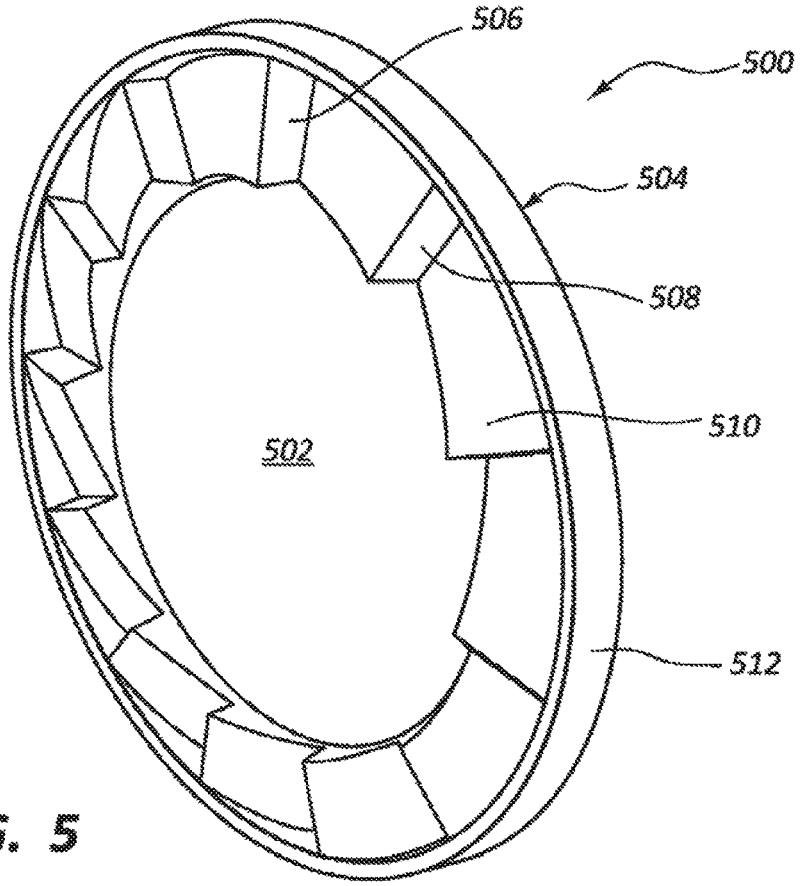
FIG. 5 depicts an example of a cooling mechanism in accordance with aspects of the present disclosure.

FIG. 5 illustrates an example of a cooling mechanism 500. In this example, the cooling mechanism includes an annulus 502 centrally located within the ring member 504. A plurality of fan blades 506 are distally located on the annulus 502. Each of the fan blades 506 includes a leading side 508 and a trailing side 510. The leading side 508 includes an edge face that extends from a base of the ring member 504. The trailing side 510 of the fan blade progressively tapers towards an adjacent fan blade and towards the base of the ring member 504. A circumferential lip 512 is disposed distally to the fan blades 506 and includes a height that is substantially the height of the blades' edge face.

Figure 6:
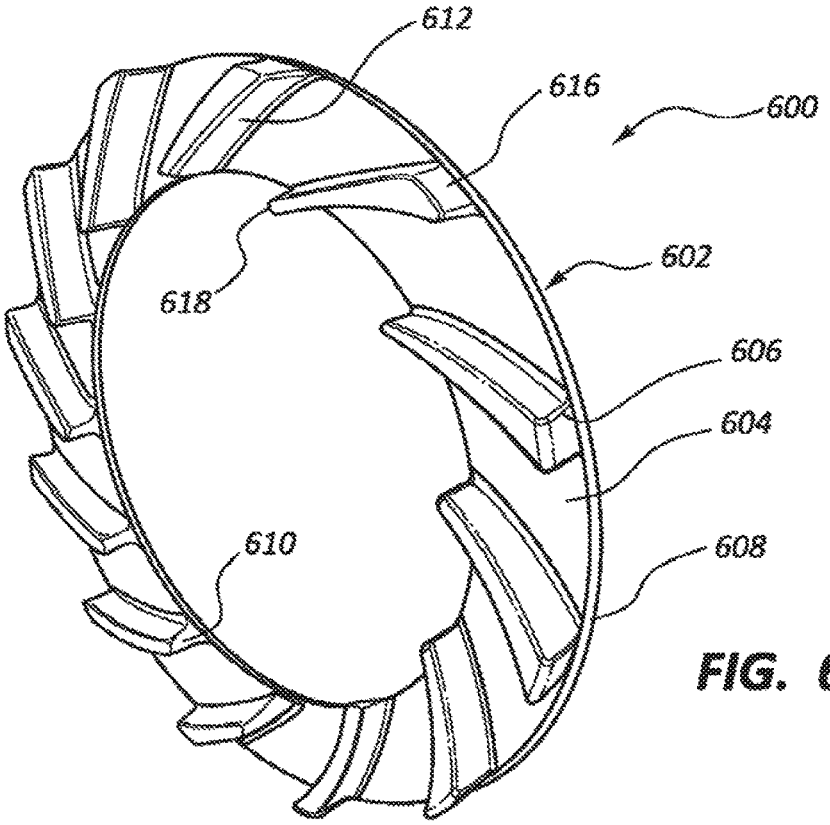
FIG. 6 depicts an example of a cooling mechanism in accordance with aspects of the present disclosure.

FIG. 6 illustrates an example of a cooling mechanism 600. In this example, the cooling mechanism 600 includes a ring member 602 with a fan face 604. A plurality of fan blades 606 are formed in the fan face 604. The fan blades 606 span the fan face from an outer ring diameter 608 to an inner ring diameter 610. Each fan blade 606 includes a leading side 612, a distal side 614, a trailing side 616, and a proximal side 618. In this example, the distal side 614 of the fan blades is forward of the proximal side 618. Additionally, the cross sectional thickness of the fan blade at the distal side 614 is greater than the fan blade's cross sectional thickness at the proximal side 618. The leading side 612 of the fan blade 606 has a slightly concave surface and the trailing side 616 has a slightly convex surface. In this example, the ring member 602 does not include a circumferential lip.

Figure 7:
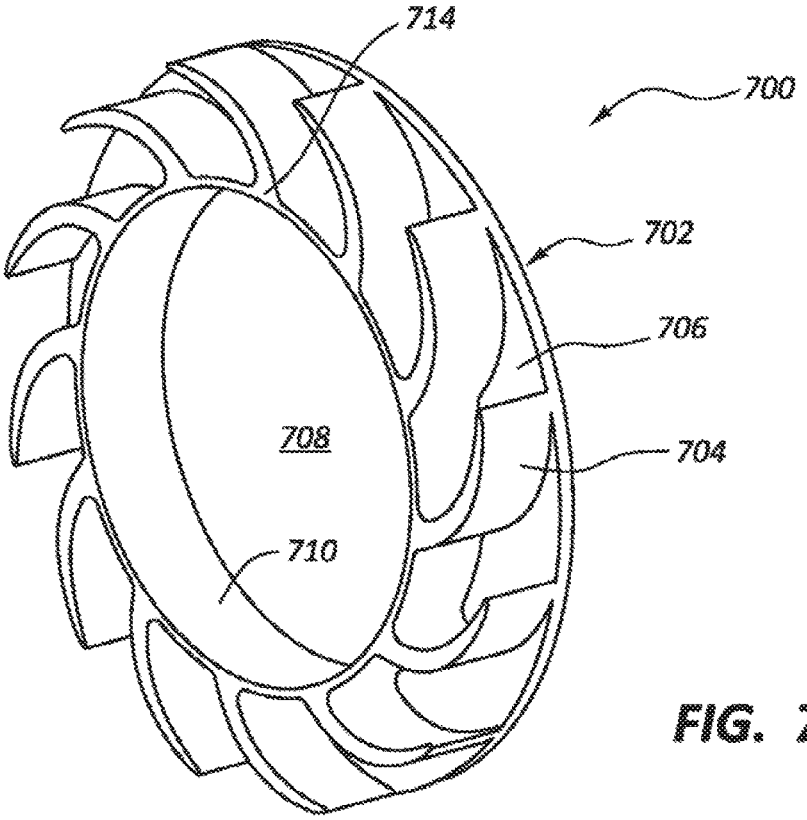
FIG. 7 depicts an example of a cooling mechanism in accordance with aspects of the present disclosure.

FIG. 7 illustrates an example of a cooling mechanism 700. In this example, the ring member 702 includes a plurality of fan blades 704 spaced along the ring's fan face 706. The ring member 702 includes an inner diameter defined by an annulus 708 in the ring member 702. An inner circumferential lip 710 is located on the inner diameter 712 which is integrally formed with the proximal sides 714 of the fan blades 704.

Figure 8:
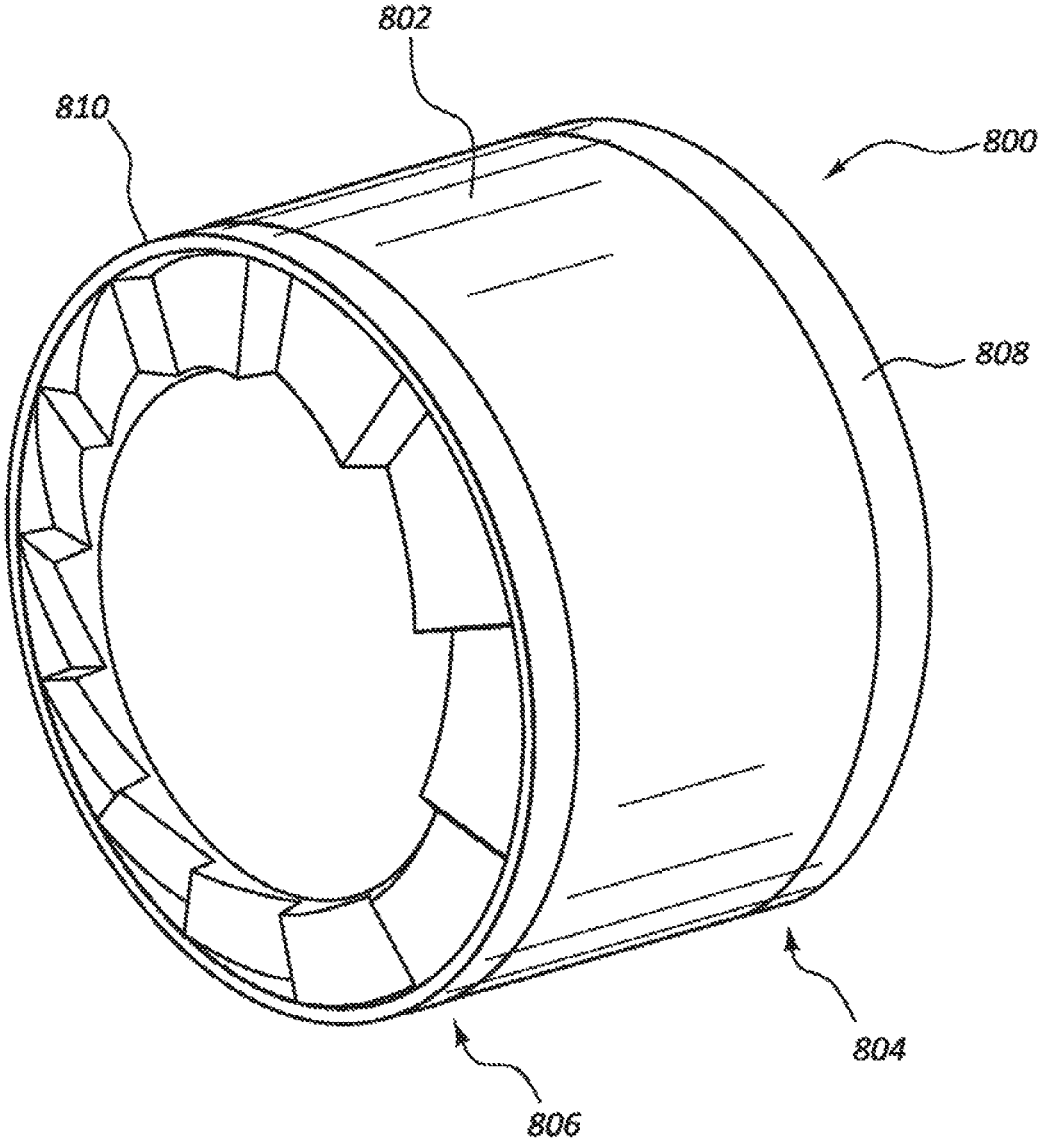
FIG. 8 depicts an example of a cooling mechanism in accordance with aspects of the present disclosure.

FIG. 8 illustrates an example of a cooling mechanism 800. In this example, the cooling mechanism 800 includes a flywheel 802 with a first side 804 and a second side 806 opposite the first side 804. A first fan assembly 808 may be attached to the first side 804, and a second fan assembly 810 may be attached to the second side 806. As the flywheel 802 rotates, the first fan assembly 808 and the second fan assembly 810 may rotate simultaneously causing separate airflows to be generated. In some cases, the lift motor may be primarily cooled by an airflow generated by the first fan assembly 808 and the drive motor may be primarily cooled by an airflow generated by the second fan assembly 810.

Figure 9:
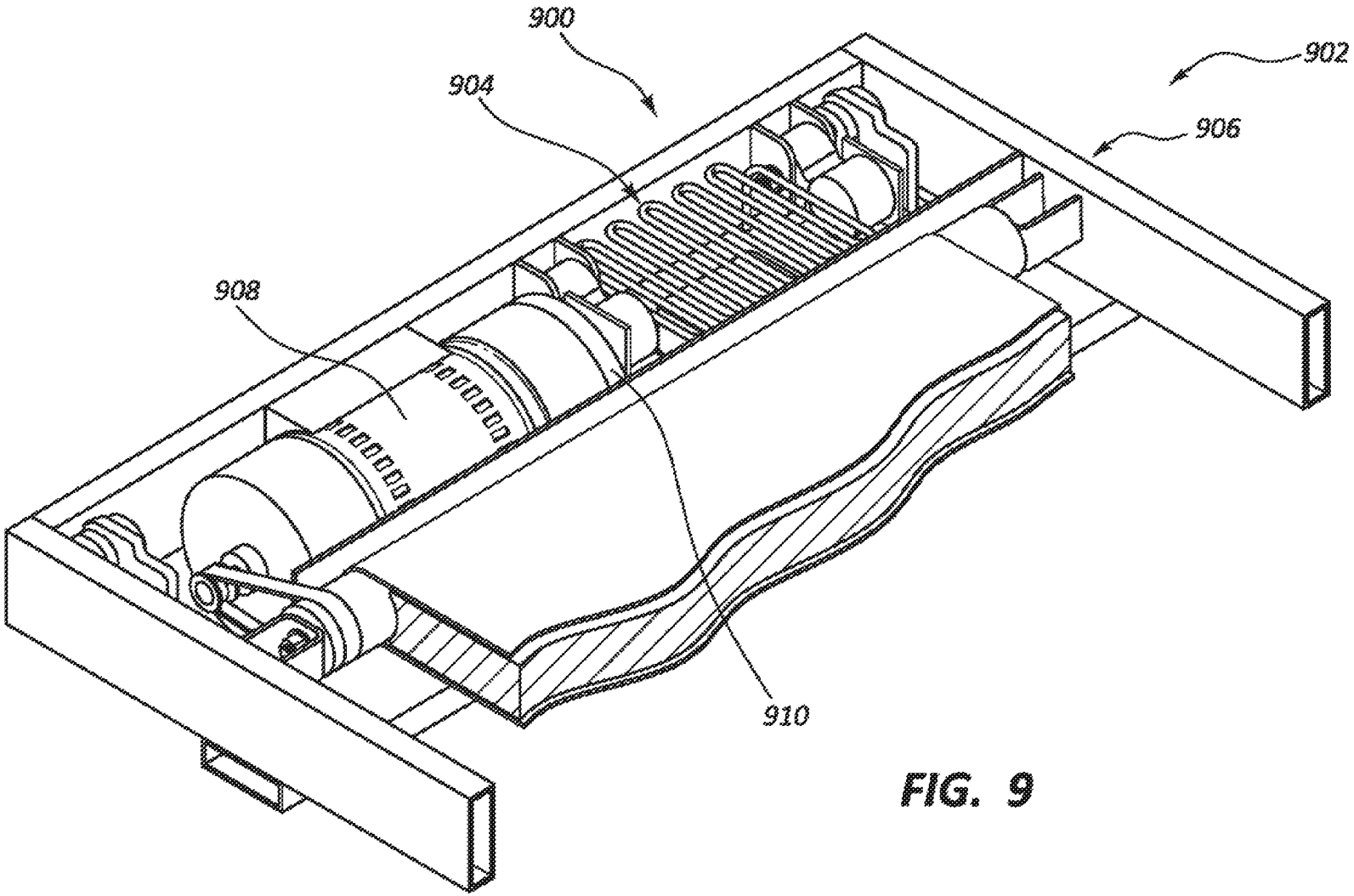
FIG. 9 depicts an example of a cooling mechanism in accordance with aspects of the present disclosure.

FIG. 9 illustrates an example of a cooling mechanism 900 in a treadmill 902. In this example, a dump resistor 904 is located within the housing 906. The dump resistor 904 may be used to dissipate unneeded electricity in the system. In some cases, the drive motor 908 may be the source of unneeded electricity. For example, in some cases the load on the motor is progressively reduced as the incline on the deck increases because the user's body weight contributes to moving the tread belt. At some incline angles, the user's body weight may generate all the force necessary to move the tread belt, so that there is no load on the drive motor. But, at even steeper incline angles, the user's body weight moves the tread belt, which correspondingly moves the pulley and therefore the drive motor 908 to the point where the drive motor 908 generates electricity. This generated electricity may be directed to the dump resistor 904 which converts the unneeded electricity into heat. The dissipated heat increases the temperature in the housing. The fan assembly 910 may be used to cool the interior of the housing.

Figure 10:
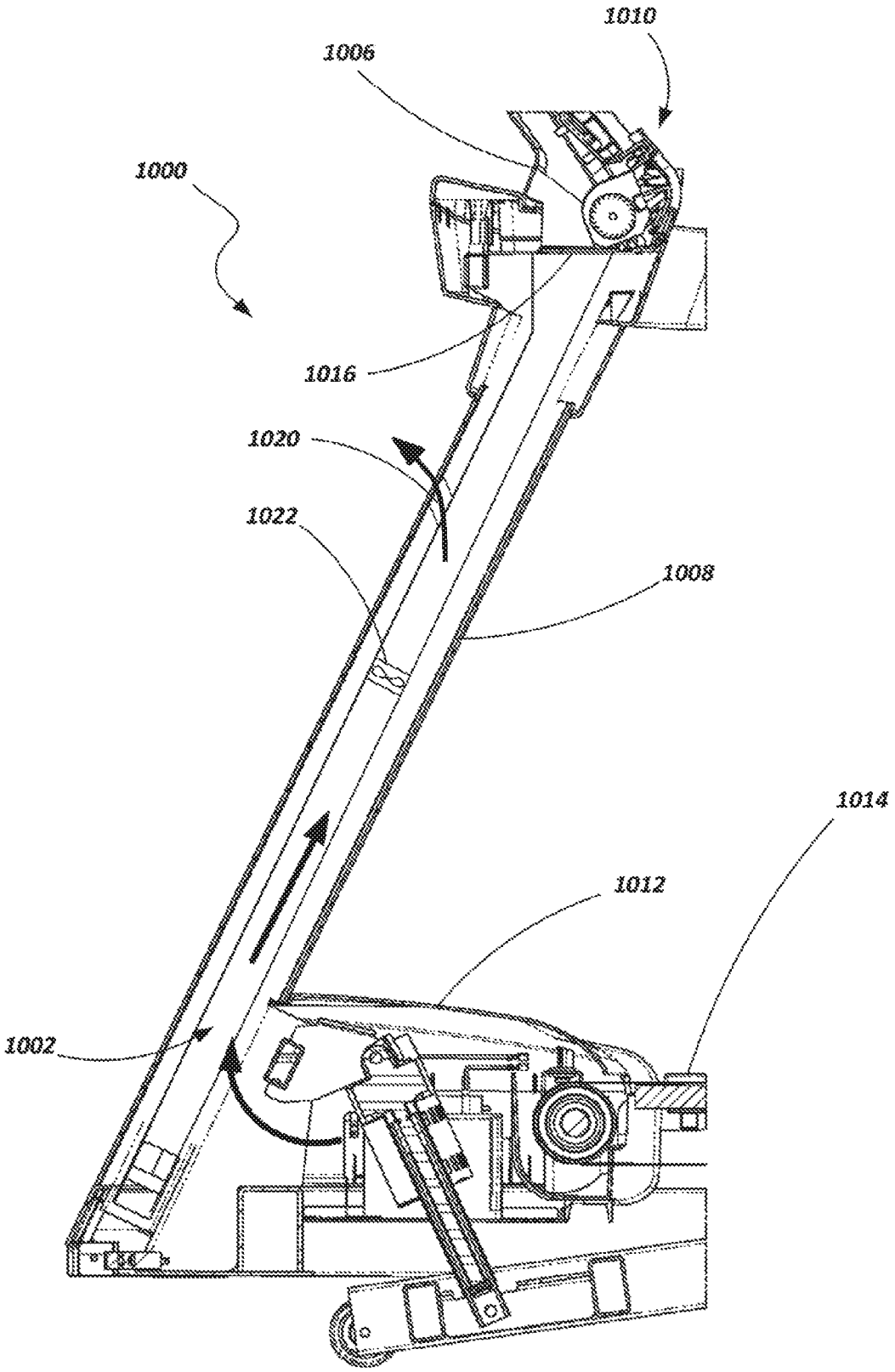
FIGS. 10-12 depict an example of an exercise machine incorporating a cooling system in accordance with aspects of the present disclosure.
Figure 11:
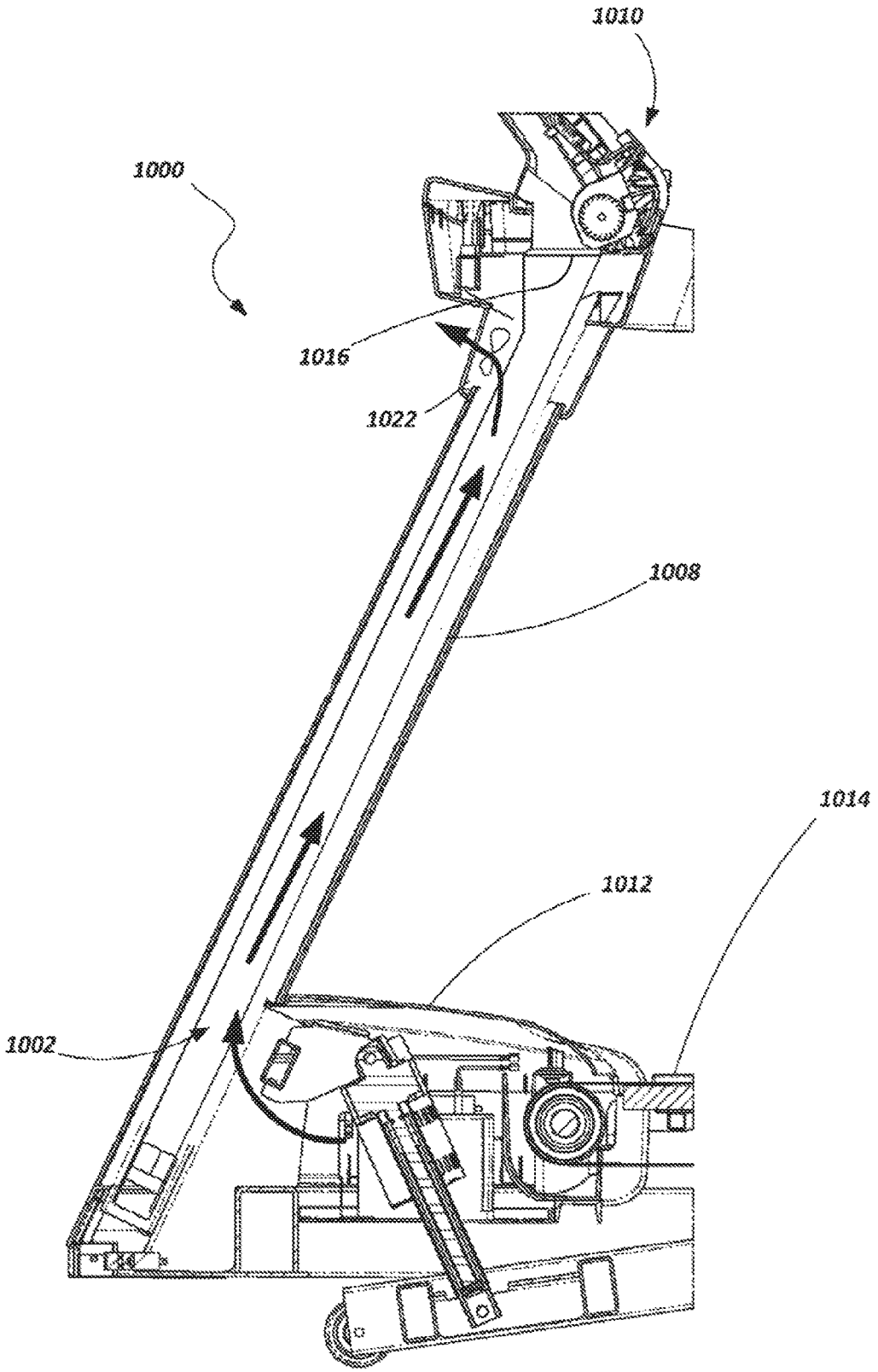
Figure 12:
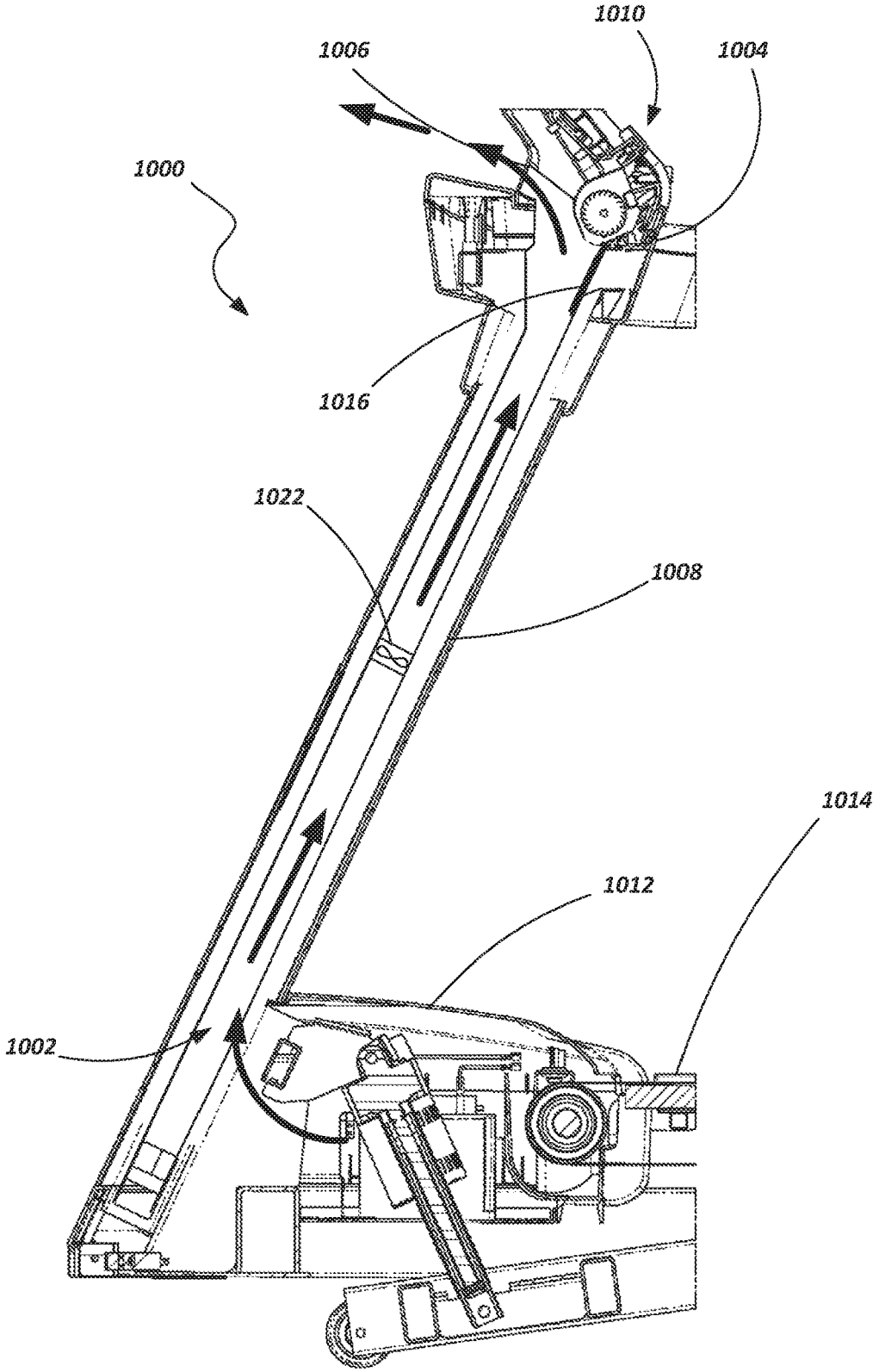

FIGS. 10-12 illustrate a treadmill 1000 that includes an airflow channel 1002 directing air from a fan (e.g., fan assembly 212 of FIG. 2) to one or more specified exhaust ports or vents 1006, 1020. In one example, an air channel 1002 is formed within one or both posts 1008 of the treadmill 1000 up into an internal area associated with the console 1010. Thus, airflow that is generated by a lift-motor (or other) fan assembly located within the shroud or cover 1012 (e.g., the cover associated with the drive and lift mechanisms) is directed to the console 1010 and exits through one or more of the exhaust vents 1006, 1020. While one exhaust vent 1020 is shown on the post 1008 of the treadmill 1000, any number of exhaust vents 1020 may be formed in the post to exhaust the airflow originating in the shroud or cover 1012.

As seen in FIG. 10, air generated by a fan within the cover 1012 can be directed through the post(s) 1008, in the direction towards the console 1010, but out a vent 1020 located in the posts such that the airflow exhausts at a location over the deck 1014 of the treadmill 1000. In the example shown in FIG. 10, the direction of the air through the vent 1020 in the posts is effected by positioning a damper or airflow damper or diverter 1016 to a first position that blocks air flow through the console.

FIG. 11 depicts an example of an auxiliary fan 1022 located in the posts that forces air out of the vent 1020 in the posts. In this examples, the airflow diverter 1016 is closed off to the vent 1006 in the console 1010, which forces the air out of the posts.

When the airflow diverter 1016 is changed to a second position, such as shown in FIG. 12, airflow generated within the cover 1012 may be directed through the post(s) 1008, into the console 1010, and out a rear facing vent 1006. While the airflow diverter is shown in a specific position, the diverter 1016 may be adjusted to a variety of positions to afford varying levels of airflow above the deck 1014 and blowing out the console.

In some cases, the airflow diverter may be coupled with an actuator to displace the diverter between its various positions. The actuator may be controlled by a user of the treadmill using an input device or mechanism (e.g., 120 of FIG. 1). In other cases, the actuator may be controlled by a program to control the airflow exiting above the deck and onto a user in accordance with a desired exercise program or to correspond with an intensity of the workout experienced by the user (e.g., higher running speeds and/or larger inclines may correspond to a higher airflow from the front vent).

In some cases, the airflow diverter 1016 may be positioned as shown in FIG. 10 upon starting operation of the treadmill, such that all of the airflow initially exhausts through the vent 1020 in the post 1008. A user may then adjust the airflow as desired. In some cases, the airflow diverter may start in the position shown in FIG. 10, and then a control program of the treadmill may alter its position depending on one or more operating characteristics of the treadmill 1000.

In some examples, the console may include a separate fan that is used to direct air towards the user. This fan may pull air from sources outside of the motor housing or other components of the treadmill. For example, this fan may pull air from the ambient environment. As illustrated in FIGS. 10-12, the one or more auxiliary fans 1022 are positioned in the air channel 1002 on each post 1008 and exhausted to the rear of the treadmill 1000 away from a user. Thus, the air pulled by the console fan is taken substantially from the ambient environment, rather than from the air that has been heated from the operation of the treadmill and exhausted through the vent 1020. In some cases, one or more auxiliary fan 1022 may be positioned at other locations in the airflow path to further enhance circulation of the airflow from the area within the cover 1012 up to the vents 1006. Such fans 1022 may be positioned in the posts 1008 in the console, or at any other point within the flow path.

In some cases, the flow path may be directed within the console to cool additional components prior to being exhausted through one or more vents 1006, 1020. For example, the airflow path may traverse a control board, a processor, or other electronic components to remove heat from such components prior to being exhausted from the console.

While the examples above have been described with the outlet being located in the console, the outlet may be located in other areas of the treadmill that are above the deck. For example, outlets may be located within the posts that support the console. Diverters and other components to direct the air flow may direct the air flow out the outlets of the posts and/or console as instructed by the user.

GENERAL DESCRIPTION

In general, various embodiments according to the present disclosure may provide users with an exercise machine that can cool its internal components during the performance of an exercise. In some cases, a workout program may involve raising and lowering the deck. Each time that the deck is moved upwards or downwards, a demand is made on the lift motor. Lift motors are not generally used continuously throughout a workout. Typically, an exercise program performed on a treadmill involves moving the deck to an incline and keeping the deck at that angle. But, the lift motor may generate heat as it is used. In some cases, when the lift motor increases its temperature, the components around the lift motor may also experience an elevated temperature. Thus, the lift motor may increase the temperature of the exercise machine's other components, which can negatively impact their performance as well. Under some conditions, the heat generated in the lift motor degrades the seals, fluids, and other lift motor components.

The cooling mechanisms and systems described herein may be used to lower the temperature of the lift motor and/or other components of the treadmill. Additionally, the cooling mechanisms and systems herein may be associated with a flow path that provides cooling of the treadmill.

A treadmill includes a deck which may further include a first pulley located in a front portion of the deck and a second pulley located in a rear portion of the deck. A tread belt may surround the first and second pulleys and provide a surface on which the user may exercise. At least one of the first pulley and the second pulley may be connected to a drive motor so that when the drive motor is active, the pulley rotates. As the pulley rotates, the tread belt moves as well. The user may exercise by walking, running, or cycling on the tread belt's moving surface.

The deck may be capable of having its front portion raised and lowered as well as its rear portion raised and lowered to control the lengthwise slope of the running deck. With these elevation controls, the orientation of the running deck can be adjusted as desired by the user or as instructed by a programmed workout. In those examples where the treadmill is involved with simulating a route that involves changes in elevation, the running deck can be oriented to mimic the elevation changes in the route while the user performs an exercise on the deck.

In one example, the lengthwise slope and/or lateral tilt angle of the deck can be controlled with one or more lift motors. In one example, a single lift motor connects the deck and the exercise machine's base. In this example, when the single lift motor extends a rod, the deck's incline angle increases and when the lift motor retracts the rod, the deck's incline angle decreases.

Any appropriate trigger may be used to cause the lift motor to change the deck's incline angle. In some cases, the incline angle is changed in response to an input from the user, a simulated environment, a programmed workout, a remote device, another type of device or program, or combinations thereof.

In some cases, the exercise machine includes a console attached to an upright structure. In some cases, the upright structure includes a first post adjacent to a first side of the deck and a second post adjacent to a second side of the deck. In this example, the console is supported by the first and second post. The deck moves independently of the first and second posts and also moves independently of the console. In other examples, the posts may move with the deck as the deck's incline angle changes.

The console may locate a display screen and the treadmill's controls within a convenient reach of the user to control the operating parameters of the treadmill. For example, the console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the console, monitor the user's heart rate or other physiological parameters during the workout, perform other tasks, or combinations thereof. Buttons, levers, touch screens, voice commands, or other mechanisms may be incorporated into the console and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route.

Also, if the route has a lateral tilt angle, the running deck may be tilted laterally to the appropriate side of the running deck to mimic the lateral tilt angle.

While the programmed workout or the simulated environment may send control signals to orient the deck, the user may, in some instances, override these programmed control signals by manually inputting controls through the console. For example, if the programmed workout or the simulated environment cause the deck to be steeper than the user desires, the user can adjust the deck's orientation with the controls in the console.

Any appropriate type of lift motor may be used in accordance with the principles described herein. For example, a non-exhaustive list of lift motors that may be used includes screw motors, linear actuators, hydraulic motors, pneumatic motors, solenoids, electro-mechanical motors, other types of lift motors, or combinations thereof. Further, the lift motor may be powered with compressed gas, electricity, magnetic fields, other types of power sources, or combinations thereof. Further, the lift motors may also have the ability to laterally tilt the running deck to any appropriate angle formed between a running surface of the running deck and the surface upon which the treadmill rests. For example, the range of the lateral tilt angle may span from negative 55 degrees to positive 55 degrees or any range there between.

Any appropriate type of drive motor may be used to drive the tread belt in a rotational direction. In some examples, the drive motor may be an alternating current motor that draws power from an alternating power source, such as the power circuit of a building. In some cases, the drive motor is a direct current motor. In some of the examples with a direct current motor, the direct current motor draws power from a building power circuit, but the alternating current is converted to direct current.

A flywheel may be connected to a portion of the drive motor so that the flywheel rotates when the drive motor is active. The flywheel may store rotational energy and assist with moving the tread belt at a consistent speed. In some examples, the flywheel has a common rotational axis with the drive motor. In these examples, the flywheel may be connected to the drive motor with an axle. In other situations, the flywheel is attached directly to a side of the drive motor. The flywheel may include any appropriate size, shape, length, width, and weight in accordance with the principles described herein.

The lift motor may operate independent of the drive motor. In some examples, the lift motor may be active when the drive motor is dormant. In other situations, the drive motor may be active when the lift motor is dormant. In some situations, the lift motor and the drive motor may be operated simultaneously, but driven in response to different command sources.

In some cases, the drive motor, flywheel, and the lift motor reside within a common housing. The housing may be incorporated into the deck adjacent to at least one of the motors. In some cases, a lift motor is incorporated in the front portion of the deck, and the housing is located in the front housing of the deck. In other examples, a lift motor is incorporated into a rear portion of the deck, and the housing is incorporated in the rear portion of the deck. In other examples, deck includes a lift motor in the front portion of the deck and in the rear portion of the deck where the elevation of the front and rear portions of the deck can be controlled independently.

As previously noted, the temperature of the lift motor may increase based on continued use or from other causes. A cooling mechanism may be incorporated into the housing to lower the internal temperature of the housing and/or lower the lift motor's temperature. In some examples, the cooling mechanism includes a fan assembly that is attached to the flywheel.

Any appropriate type of fan assembly may be used in accordance with the principles described in the present disclosure. In one example, the fan assembly includes a ring member that defines a central annulus. The ring member may include a fan face and an attachment face opposite of the fan face. The attachment face may connect to the flywheel, and a fan blade may be formed on the fan face. In some examples, the fan blade includes a geometry that forces air to move in response to the rotation of the ring element. In some cases, the fan blades are protrusions that extend beyond the fan face. These blades may include any appropriate type of shape including, but not limited to, a generally rectangular shape, a generally crescent shape, a generally square shape, another general shape, or combinations thereof. In some cases, the blade generates lift, which causes the high and low pressure regions of the air in the immediate vicinity of the blade as the ring element rotates.

In some cases, the ring element includes a lip that protrudes from the fan face's edge and extends away from the fan face in the same direction as the fan blade extends from the fan face. The lip may extend away from the fan face at the same distance as the fan blades. In some cases, the circumferential lip may extend away from the fan face at a greater distance than the fan blade. In yet other examples, the fan blades may extend from the fan face at a greater distance than the lip extends. The lip may contribute to directing the airflow generated by the fan assembly.

In some examples, a low pressure region is generated within the annulus of the ring element when the fan assembly rotates. As a result, air is pulled into the annulus. In those examples where the ring member is attached to the side of the flywheel, the flywheel blocks air from traveling through the annulus which focuses the airflow to the side. The shape of the fan blades may also direct the airflow to the side. The air that is directed to the ring member's side is forced forward of the fan face as the air moves towards the lip attached to the ring's circumferential edge. The lip blocks the air from flowing directly off of the ring element's side. Thus, the airflow that is pulled towards the annulus of the ring member is rerouted to move in an opposing direction. In some cases, the airflow is rerouted 180 degrees. In some examples, the airflow is rerouted between 120 degrees to 175 degrees. The redirected airflow may be contained within the housing. As the redirected airflow travels off of the fan face at an angle, the airflow may generate low pressure regions behind the fan assembly. These low pressure regions may cause air to flow within other regions within the housing.

In other examples, the ring member includes a fan face without the circumferential lip. In these examples, the airflow may exit the fan face directly off of the ring member's side. Initial testing shows that those ring members with a circumferential lip on the ring's outer diameter result in a fifty percent noise reduction than those ring members without a circumferential lip.

The lift motor may be located on the fan side of the ring member within the housing. Thus, when the flywheel rotates, the fan assembly may draw in air into the annulus so that air is pulled across the lift motor. As a result, the airflow may remove heat from the lift motor. In other examples, the lift motor may be located elsewhere within the housing and the entire interior of the housing may be lowered as a result of the fan assembly's operation. In some cases, the housing may include vent openings that allow hot air to exit the housing and cool air to be drawn into the housing. The vent openings may be located on an underside of the housing to prevent sweat, liquid, debris, or other substances from falling into the vent holes.

The cooling mechanism as described herein may lower the temperature of the machine's components located within the housing. In particular, the fan assembly may be oriented to generate an airflow across the lift motor to cool the lift motor. Lowering the temperature of the lift motor may reduce the rate of degradation of the lift motor's seals, fluids, and other components. Further, initial testing of cooling mechanisms as described herein have lowered the temperature of the internal housing by 20 degrees Celsius. Another benefit to the cooling mechanism as described herein is the effective temperature differential in a tight space that cannot accommodate bulky or large cooling assemblies.

While the examples above have been described with reference to cooling the lift motor, the cooling mechanism may be used to cool other exercise machine components in addition to or in lieu of the lift motor. For example, some exercise machines may include a printed circuit board with cooling fins. The increased airflow may make the fins of the printed circuit board remove heat more effectively.

In some examples, the load on the drive motor diminishes as the incline of the deck increases. As the incline angle of the deck increases, the user's body weight pushes the tread belt down the length of the deck. In some cases, when the deck's incline angle reaches 12 degrees, the user's body weight is sufficient to drive movement of the tread belt. This can cause the electric motor to operate in reserve causing the motor to generate electricity. The generated electricity can be directed to a dump resistor where the electricity is converted into heat. In examples where the dump resistor is located within the housing, the fan assembly may direct an airflow across the dump resistor to remove the resistor's heat. In some cases, the dump resistor may have a coiled geometry. In other examples, the dump resistor may have a flat geometry with multiple turns. Regardless of the dump resistor's geometry, the increased airflow across the resistor's surface may reduce the resistor's temperature.

In some examples, the flywheel is connected to multiple fan assemblies. For example, a first fan assembly may be connected to a first side of the flywheel, and a second fan assembly may be connected to a second side of the flywheel that is opposite of the first side. The first fan assembly may generate a first airflow that causes air to pass through the lift motor while the second fan assembly may generate a second airflow that causes air to pass through the drive motor which may lower the temperature of the drive motor. In other examples, additional fan assemblies may be connected to the flywheel with an axle. In this type of example, the fan assemblies may be connected in series and be spaced apart from each other.

In some cases, the fan assembly is attached to the flywheel. In other examples, the fan assembly is integrally formed in the flywheel. Further, in some cases, the fan assembly is attached to the side of the flywheel. In yet other examples, the fan assembly is disposed about the circumference of the flywheel.

In some examples, the fan assembly may be a centrifugal fan where the fan assembly includes an impeller that includes a series of blades. The fan assembly blows air at right angles to the intake of the fan through a centrifugal force.

In some examples, a clutch mechanism may be installed between the flywheel and the fan, enabling selective disengagement of the fan from the flywheel. Thus, even though the flywheel may be rotating, if the clutch is not engaged, the fan will not rotate with the flywheel. In some embodiments, the clutch may include an electromagnetic clutch. In some embodiments, the clutch may be configured in a "normally engaged" status, meaning that the fan is engaged with the flywheel and rotates with the flywheel when operation of the treadmill is started. The clutch may then stay in the engaged status until it is selectively disengaged.

Any appropriate trigger may be used to cause disengagement of the clutch. In some cases, the clutch is disengaged in response to an input from the user, a simulated environment, a programmed workout, a remote device, another type of device or program, or combinations thereof. Likewise, any appropriate trigger, such as those noted above, may be used to cause reengagement of the clutch.

An airflow path may be provided from the area associated with the fan (e.g., the area within the shroud or cover and associated with the drive motor and/or lift mechanism) to exhaust the airflow to a desired location. In some embodiments, an airflow path may be provided from a location adjacent a fan assembly to the console, and through one or more exhaust or outlet vents. In some embodiments, an exhaust vent may be configured to direct some or all of the airflow exhaust to a location directly above the deck of the treadmill to blow on, and cool, a user of the treadmill.

In some embodiments, multiple exhaust vents may be utilized. An airflow diverter may be used to proportion the amount of airflow exhausting from each vent. In some embodiments, the airflow diverter may be used to selectively and completely divert the airflow solely to any one of the exhaust vents. For example, when the airflow diverter is in one selected position, it may direct all airflow such that exhausts above the treadmill deck as noted above. When the airflow diverter is in a second position, it may direct a portion of the airflow above the deck, and direct a portion to another location (not above the deck) and away from the user. When the airflow diverter is in a third position, it may direct all airflow to exhaust to a location away from the deck and user of the treadmill. The flow diverter may be infinitely adjustable to provide a variety of adjustment levels to the airflow exhausting above the deck.

In some embodiments, the cooling system, including software instructions, is arranged such that the auxiliary fan runs and all of the airflow is exhausted through the back side of the console above the deck upon starting operation of the treadmill. Thus, the diverter may be initially positioned, upon each operational start of the treadmill, to divert all airflow through one or more exhaust vents to a location above the deck away from the user. A user may then manually adjust the diverter to alter the airflow if desired. Alternatively, or additionally, other triggers may alter the position of the diverter after operation of the treadmill has started. Such triggers may include, for example, a simulated environment, a programmed workout, a remote device, another type of device or program, or combinations thereof.

In some embodiments, the airflow channel may include a pathway through one or more posts of the treadmill up to the console. In some embodiments, inlet vents may be placed in the posts, or at any other location along the airflow path, to enable ambient air to be drawn into the airflow channel and mix with air that is being drawn across the lift motor, drive motor or other related components. The mixture of ambient air may provide some cooling to the air drawn from within the shrouded or covered area prior to exhausting through the back side of the console.

In some embodiments, one or more auxiliary fans, such as an electric fan, may be placed at another location within the airflow path. For example, an auxiliary fan may be placed in a post (or one in each post), within the console, or at some other location. The auxiliary fan may be configured to operate in conjunction with the fan assembly coupled with the flywheel (e.g., turn on when the clutch is engaged, and off when the clutch is disengaged), or operate independent from the fan assembly. In one embodiment, the auxiliary fan or fans may be configured to start when the treadmill is started by a user for operation. In some embodiments, a user may then manually turn off the auxiliary fan(s). Alternatively, or additionally, other triggers may alter the operation of the auxiliary fan(s) after operation of the treadmill has started. Such triggers may include, for example, a simulated environment, a programmed workout, a remote device, another type of device or program, or combinations thereof.

In some embodiments, the airflow path may be defined to provide cooling to additional components of the treadmill. For example, the airflow path may be arranged such that air flows over, and provides cooling to, control boards, processors, displays, or other electronic components, including those associated with the console.

While the examples above describe a cooling mechanism that can be used in relation to a treadmill, the cooling mechanism may be used in any appropriate type of exercise machine. For example, the fan assembly may be attached to the flywheel of a resistance mechanism. In these types of examples, the resistance mechanisms may be incorporated into stationary bikes, elliptical trainers, rowing machines, or other types of exercise machines. The fan assemblies may be used to cool the components of the exercise machine. These component may include motors, lift motors, dump resistors, electronics, bearings, sensors, other types of components, or combinations thereof.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. An exercise machine comprising:

a deck;

a motor housing incorporated into the deck;

a console positioned at an elevation above the motor housing;

a fan associated with at least one of a lift motor and a drive motor located in the motor housing;

an airflow pathway extending from a location adjacent the fan through a first outlet vent located in a location above the motor housing; and a mechanism configured to selectively alter airflow flowing through the airflow pathway.

2. The exercise machine of claim 1, wherein the mechanism includes a clutch coupled with the fan.

3. The exercise machine of claim 2, wherein the clutch includes an electromagnetic clutch.

4. The exercise machine of claim 3, wherein the clutch is in a normally engaged state.

5. The exercise machine of claim 1, wherein the mechanism includes a diverter.

6. The exercise machine of claim 5, wherein the diverter is displaceable between at least two different positions, including a first position wherein substantially all airflow is directed through the first outlet vent, and a second position wherein all airflow is directed through a second vent to a location away from the location above the motor housing.

7. The exercise machine of claim 6, wherein the diverter is displaceable to at least a third position wherein a first portion of the airflow is directed through the first outlet vent and a second portion of the airflow is directed through the second outlet vent.

8. The exercise machine of claim 5, wherein the diverter is in the first position upon starting operation of the exercise machine.

9. The exercise machine of claim 1, further comprising at least one post member extending from a location adjacent the deck up to the console, and wherein the airflow pathway extends through an interior portion of the at least one post member.

10. The exercise machine of claim 9, further comprising an inlet vent formed in the at least one post member and in fluid communication with the airflow pathway.

11. The exercise machine of claim 1, further comprising at least one auxiliary fan disposed within the airflow pathway.

12. The exercise machine of claim 11, wherein the at least one auxiliary fan is configured to begin operation upon starting operation of the exercise machine.

13. A method of operating an exercise machine, the method comprising:

providing a deck with a motor housing;

providing a motor in the motor housing to alter an operating characteristic of the deck;

providing a fan to circulate air over the motor;

providing an airflow pathway from a location adjacent the fan, to a first exhaust vent located in a console of the exercise machine;

exhausting substantially all airflow from the fan through the first exhaust vent to a location above the motor housing upon starting the exercise machine;

altering at least one characteristic of the airflow through the airflow pathway during subsequent operation of the exercise machine.

14. The method according to claim 13, wherein altering at least one characteristic of the airflow includes turning off the fan.

15. The method according to claim 13, wherein altering at least one characteristic of the airflow includes diverting at least a portion of the airflow through a second exhaust vent.

16. The method according to claim 13, wherein altering at least one characteristic of the airflow includes diverting substantially all of the airflow through a second exhaust vent.

17. The method according to claim 13, wherein altering at least one characteristic of the airflow is responsive to a user command.

18. The method according to claim 13, wherein altering at least one characteristic of the airflow is responsive to a command associated with a predefined workout program.

19. A treadmill, comprising:

a deck;

a motor housing incorporated into the deck;

a first pulley incorporated into the deck;

a tread belt incorporated into the deck and in engagement with the first pulley;

a drive motor located within the motor housing in mechanical communication with the first pulley;

a flywheel being rotationally fixed with respect to the drive motor where the drive motor causes the tread belt to move in a rotational direction and causes the flywheel to spin;

a lift motor located within the motor housing;

a fan assembly that cools the lift motor;

a console;

at least one post member extending from a location adjacent the deck to the console;

an airflow path extending from the fan, through the at least one post member, through an exhaust vent located in the console; and a mechanism configured to selectively alter airflow flowing through the airflow pathway.

* * * * *